US009062448B2

(12) United States Patent
Richardson

(10) Patent No.: US 9,062,448 B2
(45) Date of Patent: Jun. 23, 2015

(54) PIVOTALLY ERECTABLE STRUCTURAL FRAME SYSTEM

(71) Applicant: Shift Strategy + Design Inc., West Vancouver (CA)

(72) Inventor: Noel John Lynn Richardson, West Vancouver (CA)

(73) Assignee: Shift Strategy + Design Inc., West Vancouver, BC (CA)

( * ) Notice: Subject to any disclaimer, the term of this patent is extended or adjusted under 35 U.S.C. 154(b) by 0 days.

(21) Appl. No.: 13/938,436

(22) Filed: Jul. 10, 2013

(65) Prior Publication Data

US 2014/0157714 A1 Jun. 12, 2014

Related U.S. Application Data

(63) Continuation of application No. PCT/CA2012/050025, filed on Jan. 13, 2012.

(60) Provisional application No. 61/432,566, filed on Jan. 13, 2011.

(51) Int. Cl.

| | |
|---|---|
| ***E04B 1/19*** | (2006.01) |
| ***E04B 1/343*** | (2006.01) |
| ***E04B 1/344*** | (2006.01) |

(52) U.S. Cl.

CPC ..... *E04B 1/1903* (2013.01); *E04B 1/34357* (2013.01); *E04B 1/344* (2013.01); *E04B 1/3441* (2013.01)

(58) Field of Classification Search

CPC ..... E04B 1/19; E04B 1/1903; E04B 7/10; E04B 2001/1984; E04B 1/344; E04B 1/3441; E04B 1/34357; E04H 15/48; E04H 15/44

USPC ..... 52/646, 645, 69, 71, 79.5

See application file for complete search history.

(56) References Cited

U.S. PATENT DOCUMENTS

| | | | | |
|---|---|---|---|---|
| 880,183 | A | 2/1908 | Apple | |
| 1,141,385 | A * | 6/1915 | Ellinger | 52/646 |

(Continued)

FOREIGN PATENT DOCUMENTS

| | | |
|---|---|---|
| CA | 2013332 | 9/1990 |
| CA | 1282610 | 4/1991 |

*Primary Examiner* — Brian Glessner
*Assistant Examiner* — Adam Barlow
(74) *Attorney, Agent, or Firm* — Todd A. Rattray; Oyen Wiggs Green & Mutala LLP

(57) ABSTRACT

A building frame module comprises first and second parallelogram-collapsible frame sections. Each frame section comprises: a plurality of elongate, rigid first frame members; and a plurality of elongate, rigid second frame members. Each second frame member is single-axis pivotally coupled at spaced apart locations to at least two of the plurality of first frame members and each first frame member is correspondingly coupled to at least two second frame members. The building frame module also comprises a plurality of elongate, rigid cross-link members. Each cross-link member links a second frame member of the first frame section to a second frame member of the second frame section. Each cross-link member is single-axis pivotally coupled to each second frame member that it links for relative pivotal movement therebetween. Each coupling between a cross-link and a corresponding second frame member permits pivotal movement about an axis parallel to the plane in which the corresponding frame section (which includes the second frame member) is parallelogram-collapsible.

19 Claims, 15 Drawing Sheets

(56) References Cited

U.S. PATENT DOCUMENTS

| | | | | | |
|---|---|---|---|---|---|
| 2,765,497 | A | | 10/1956 | Ludowici | |
| 2,982,379 | A | * | 5/1961 | Fisher | 52/111 |
| 3,284,966 | A | | 11/1966 | Bolt | |
| 3,766,932 | A | | 10/1973 | Sidis et al. | |
| 3,849,952 | A | * | 11/1974 | Hanaoka | 52/79.5 |
| 3,968,618 | A | | 7/1976 | Johnson | |
| 4,715,159 | A | | 12/1987 | Hijazi | |
| 4,766,708 | A | | 8/1988 | Sing | |
| 4,791,761 | A | | 12/1988 | Goudie | |
| 5,040,349 | A | | 8/1991 | Onoda et al. | |
| 5,050,353 | A | * | 9/1991 | Rogers et al. | 52/8 |
| 5,228,258 | A | * | 7/1993 | Onoda et al. | 52/646 |
| 6,141,934 | A | | 11/2000 | Zeigler | |
| 6,244,011 | B1 | | 6/2001 | Esser | |
| 6,591,849 | B1 | | 7/2003 | Swetish et al. | |
| 7,556,054 | B2 | | 7/2009 | Zeigler | |
| 7,712,261 | B2 | | 5/2010 | Zeigler | |
| 8,028,488 | B2 | * | 10/2011 | Dodd | 52/645 |
| 2004/0025466 | A1 | | 2/2004 | Hink et al. | |
| 2004/0231274 | A1 | | 11/2004 | Engstrom | |
| 2011/0308189 | A1 | * | 12/2011 | Daas et al. | 52/646 |
| 2012/0110946 | A1 | * | 5/2012 | Daas et al. | 52/646 |

* cited by examiner

PIVOTALLY ERECTABLE STRUCTURAL FRAME SYSTEM

RELATED APPLICATIONS

This application is a continuation of PCT application No. PCT/CA2012/050025 which was filed 13 Jan. 2012 and which claims the benefit of the priority of U.S. application No. 61/432,566 filed 13 Jan. 2011. Both PCT application No. PCT/CA2012/050025 and U.S. application No. 61/432,566 are hereby incorporated by reference.

TECHNICAL FIELD

The invention relates to the field of prefabricated building systems. Some embodiments provide pre-assembled steel building frames erectable by pivoting action.

BACKGROUND

In many building applications, steel (or like metal) frame construction has advantages over alternative building materials, such as wood and concrete. Conventionally, steel frame construction involves assembling separate posts, beams and/or other structural components at a building site, such as by welding, riveting or bolting. This method of construction is typically time consuming, generally requires specialized equipment (e.g., welding and cutting apparatus), and requires careful attention to the selection and alignment of components during assembly.

Pre-fabricated building systems in which structural components are delivered in partially-assembled or fully-assembled configuration are known. Some known pre-fabricated building systems are expensive, inefficient or otherwise difficult to transport because they define rigid bodies having large voids Pre-fabricated collapsible truss structures are also known. Some known prefabricated collapsible truss structures are weak, difficult to assemble, or impractical for steel frame construction of building frames.

There is accordingly a desire for methods, apparatus and systems that provide building frames that may be transported efficiently, and erected quickly and easily.

BRIEF DESCRIPTION OF THE DRAWINGS

In drawings that illustrate non-limiting example embodiments.

DETAILED DESCRIPTION

Figure 1A:
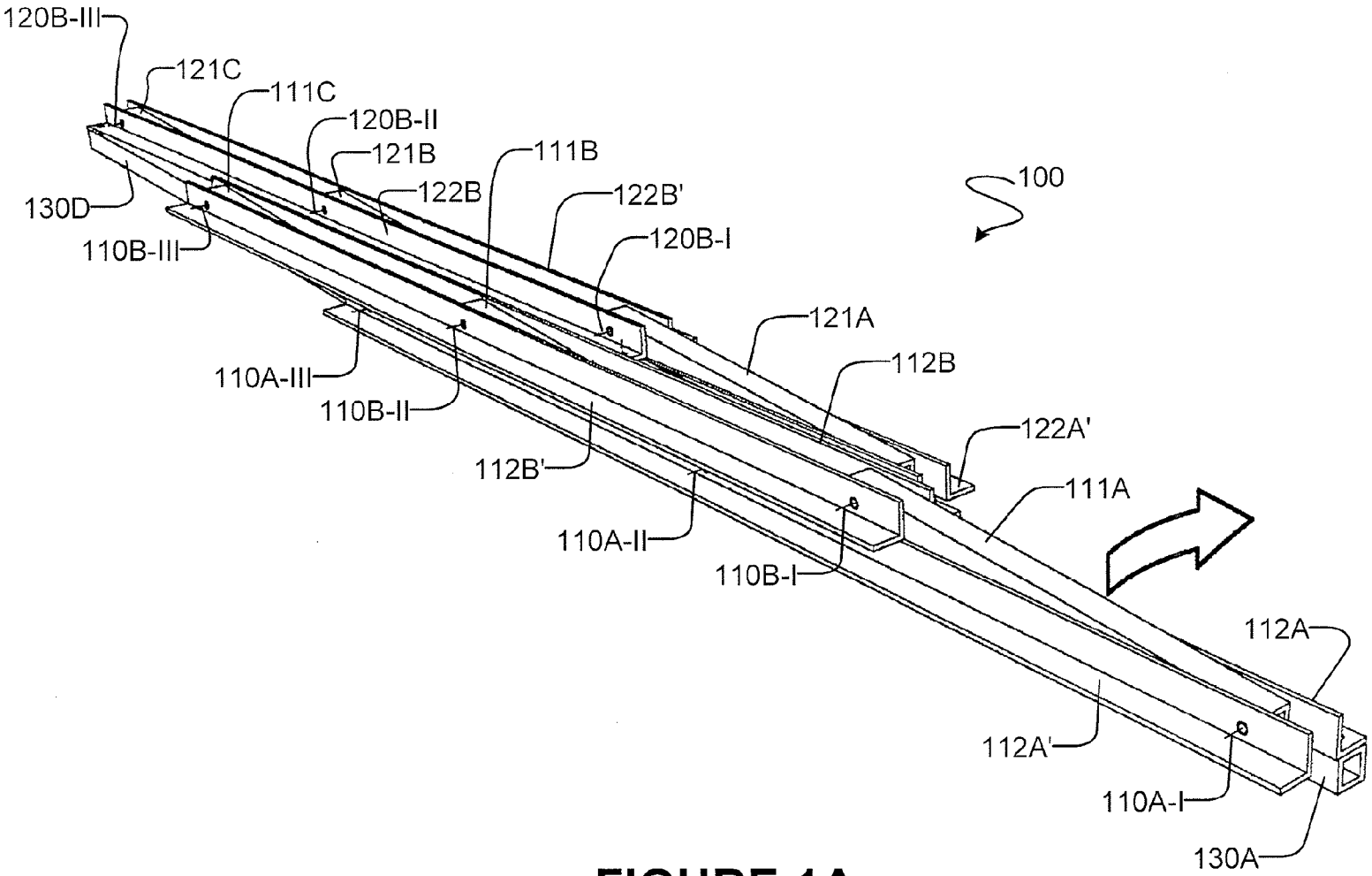
FIG. 1A is a perspective view of a frame module according to an example embodiment in a fully-collapsed configuration.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

FIGS. 1A-C, 2A-C, 3A-C, 4A-C and 5A-C show different views and different configurations of a building frame module 100 according to an example embodiment. Frame module 100 may be used to provide a structural frame, or a portion of a structural frame, for a building and/or a portion of a building. As described in further detail below, frame module 100 has features which make it suitable for use in pre-fabricated modular construction of buildings or portions thereof.

FIGS. 1A-C, 2A-C, 3A-C, 4A-C and 5A-C are labeled such that the Figure number (i.e., "1", "2", etc.) denotes the configuration of frame module 100 depicted in the Figure, and the letter (i.e., "A", "B", "C", etc.) denotes the view. Figures with the suffix "A" show perspective views, Figures with the suffix "B" show bottom plan views, and Figures with the suffix "C" show side elevation views. For convenience, the interconnection of components of frame module 100 will be described first, and the operation of the frame module described with reference to each of the different configurations described subsequently. It may be convenient to refer to FIG. 5A in reading the description of the interconnection of components of frame module 100. Directional indications (e.g., horizontal, vertical and/or the like) are provided in parentheses to assist in locating components of frame module 100 in the context of FIG. 5A, it being understood that such indications are not to be construed as limiting.

Frame module 100 comprises two interconnected, pivotally-collapsible parallelogram frame sections 110, 120. In the illustrated embodiment, frame sections 110, 120 are identical, but this is not the case in all embodiments. Frame sections 110, 120 each comprise a plurality (e.g. three) of elongate, rigid (vertical) first frame members—in the illustrated embodiment, first frame members 111A, 111B and 111C (collectively, first frame members 111) of frame section 110 and first frame members 121A, 121B and 121C (collectively, first frame members 121) of frame section 120. It is to be appreciated that the term "rigid" as used herein connotes substantial, but not necessarily total, inflexibility, such that components described using the word "rigid" may exhibit the degree of deformability inherent in common construction framing materials (e.g., structural steel, carbon fiber composites, pre-cast steel reinforced concrete, aluminum, wood, wood laminates, plastic composites, engineered materials, etc.).

In the illustrated embodiment, first frame members 111, 121 comprise rectangular cross-sectioned structural steel tubes. In some embodiments, first frame members have different cross-sectional geometry and/or are made of different material(s). For example, first frame members 111, 121 may comprise members having I-shaped, C-shaped, L-shaped, H-shaped and/or T-shaped cross-sections, tubing having other cross-sectional shapes (e.g. circular cross-section), or the like. First frame members 111, 121 need not all have the same cross-sectional geometry, or even uniform sectional geometry over their length. Other embodiments may have different numbers of first frame members (e.g., 2, 4, 5, or 6 first frame members).

In addition to first frame members 111, 121, frame sections 110, 120 each comprise a plurality (e.g. four) of elongate, rigid (horizontal) second frame members. In the illustrated embodiment, frame section 110 comprises internal second frame members 112A, 112B and external second frame members 112A', 112B' (collectively, second frame members 112) and frame section 120 comprises internal second frame members 122A, 122B and external second frame members 122A', 122B' (collectively, second frame members 122). In the illustrated embodiment second frame members 112, 122 comprise right-angle beams having L-shaped cross-section. In some embodiments, second frame members 112, 122 may have different cross-sectional geometry and/or be made of different material(s). For example, second frame members 112, 122 may comprise members having I-shaped, C-shaped, H-shaped, and/or T-shaped cross-sections, tubing having rectangular or circular cross-section, or the like. Second frame members 112, 122 need not all have the same cross-sectional geometry, or even uniform cross-sectional geometry over their lengths.

Figure 5A:
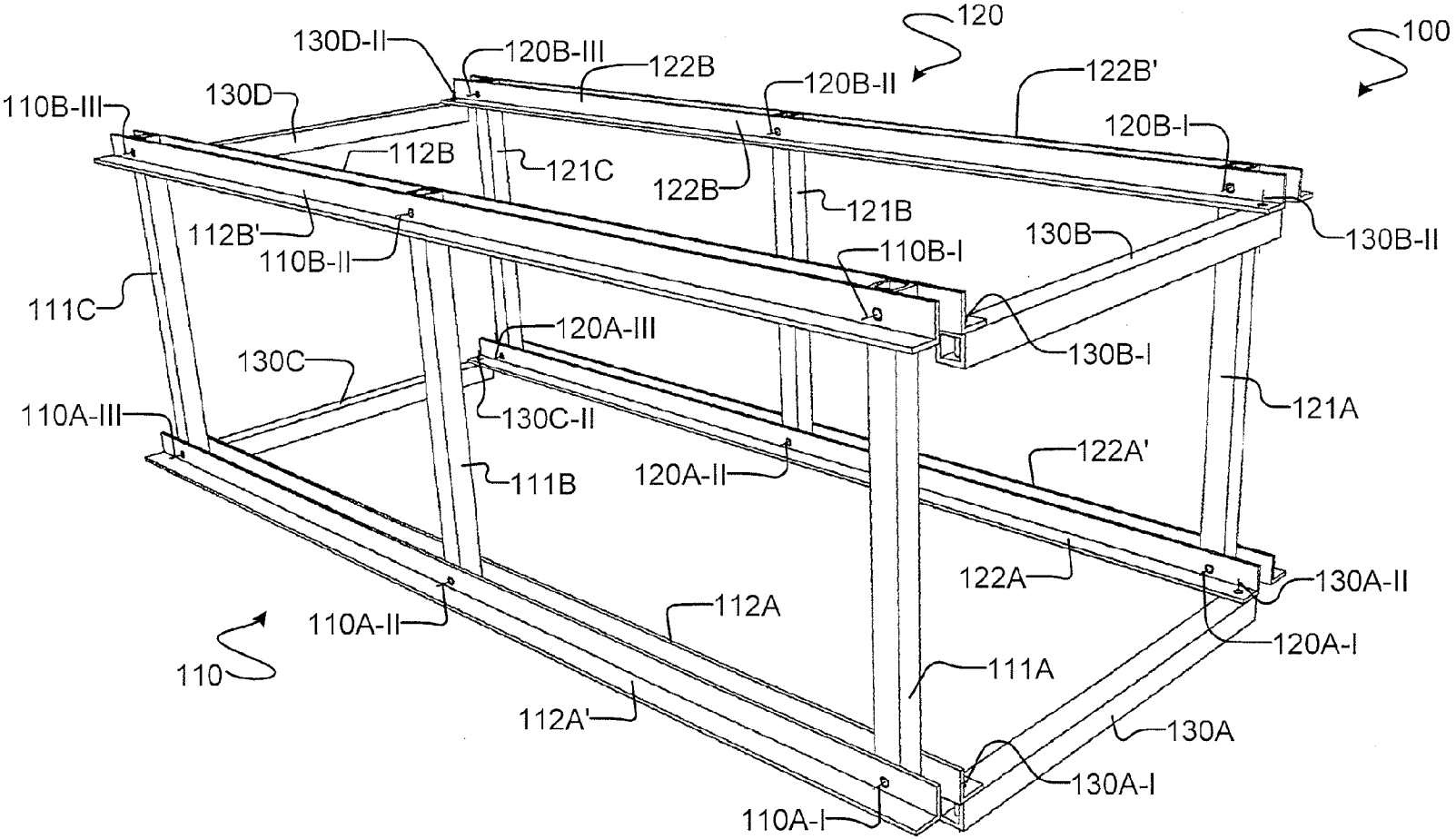
FIG. 5A is a perspective view of a frame module according to an example embodiment in a fully-erect (i.e. fully horizontally-expanded and vertically-erected) configuration.

As can be seen from FIG. 5A, second frame members 112, 122 have right-angle, L-shaped cross-sections whose vertical legs are pivotally coupled to the first frame members 111, 121 of their respective frame sections 110, 120 at spaced-apart locations. Each coupling between one of second frame members 112, 122 and one of first frame members 111, 121 provides relative pivotal movement about a single pivot axis. In frame section 110, second frame members 112A, 112A' are coupled adjacent internal and external faces, respectively, of a first (lower) end of each of first frame members 111 for pivotal movement relative to first frame members 111 confined about first (lower, horizontal) axes 110A-I, 110A-II, 110A-III, respectively. Second frame members 112B, 112B' of frame section 110 are coupled adjacent internal and external faces, respectively, of a second (upper) end of each of first frame members 111 for pivotal movement relative to first frame members 111 confined about second (upper, horizontal) axes 110B-I, 110B-II, 110B-III.

In frame section 120, second frame members 122A, 122A' are coupled adjacent internal and external faces, respectively, of a first (lower) end of each of first frame members 121 for pivotal movement relative to first frame members 121 confined about first (lower, horizontal) axes 120A-I, 120A-II, 120A-III, respectively. Second frame members 122B, 122B' of frame section 120 are coupled adjacent internal and external faces, respectively, of a second (upper) end of each of first frame members 121 for pivotal movement relative to first frame members 121 confined about second (upper, horizontal) axes 120B-I, 120B-II, 120B-III.

In the illustrated embodiment, two second frame members 112, 122 are coupled to opposite (internal and external) faces adjacent to each (upper and lower) end of every first frame member 111, 121. Other embodiments may have additional second frame members 112, 122 coupled to first frame members 111, 121 intermediate the ends thereof. For example, frame sections 110, 120 of some embodiments may have 3, 4, 5, or 6 pairs of second frame members 112, 122 coupled opposite faces of first frame members 111, 121. In some embodiments, second frame members 112, 122 are coupled to only one face of corresponding first frame members 111, 121 (e.g., in some embodiments, frame sections 110, 120 do not have external second frame members 112A', 112B', 122A', 122B'; and in some embodiments, frame sections 110, 120 do not have internal second frame members 112A, 112B, 122A, 122B). In some embodiments, second frame members 112, 122 coupled adjacent to opposite faces of the same first frame member 111, 121 do not pivot about the same axes (e.g., internal second frame members 112A, 112B, 122A, 122B and external second frame members 112A', 112B', 122A', 122B' may be offset along the length of first frame members 111, 121).

For each of frame sections 110, 120, the spacing between each pair of (vertically) adjacent (horizontal) axes linked by a first frame member is the same as the spacing between each corresponding pair of axes linked by the other first frame members of the frame section 110, 120 (e.g., the spacing between first (lower, horizontal) axis 110A-I and second (upper, horizontal) axis 110B-I linked by first frame member 111A is the same as the spacing between first (lower, horizontal) axis 110A-II and second (upper, horizontal) axis 110B-II linked by first frame member 111B and as the spacing between first (lower, horizontal) axis 110A-III and second (upper, horizontal) axis 110B-III linked by first frame member 111C). As a result, in each frame section 110, 120, the second frame members 112, 122 are parallel to one another regardless of the angular orientation between first frame members 111, 121 and second frame members 112, 122 of the frame sections 110, 120.

For each of frame sections 110, 120, the spacing between each pair of (horizontally) adjacent (horizontal) axes linked by a second frame member is the same as the spacing between each corresponding pair of axes linked by the other second frame member (e.g., the spacing between first (lower, horizontal) axes 110A-I and 110A-II, which are linked by second members 112A, 112A', is the same as the spacing between second (upper, horizontal) axes 110B-I and 110B-II, which are linked by second members 112B and 112B'). As a result, in each frame section 110, 120, the first frame members 111, 121 are parallel to one another regardless of the angular orientation between first frame members 111, 121 and second frame members 112, 122 of the frame sections 110, 120.

Because both the spacing between each pair of adjacent axes linked by a first frame member is the same as the spacing between each corresponding pair of axes linked by the other first frame members and the spacing between each pair of adjacent axes linked by a second frame member is the same as the spacing between each corresponding pair of axes linked by the other second frame members, each frame section 110, 120 exhibits pivotally collapsible/erectable parallelogram geometry (in a vertical plane). This pivotally collapsible/erectable parallelogram geometry is best exhibited by comparing FIGS. 3A, 4A and 5A, where first and second frame sections 110, 120 are shown in vertically collapsed (FIG. 3A), partially-vertically-erected (FIG. 4A) and fully-vertically erected (FIG. 5A) configurations. Because of the above-described axial spacing, the shapes of first and second frame sections 110, 120 retain their parallelogram shape exhibited in FIGS. 3A, 4A and 5A regardless of their states of vertical erection. It will be appreciated that the same conditions on axial spacing will result in pivotally collapsible/expandable parallelogram geometry in embodiments having different numbers of first frame members 111, 121 and/or second frame members 112, 122. For example, a frame section may comprise three second frame members each connected to the adjacent second frame member as described for frame section 110. Frame sections 110, 120 and similar frame sections of other embodiments which exhibit these characteristics may be referred to as parallelogram-collapsible.

First frame section 110 and second frame section 120 may be linked together by a plurality (e.g. four) of elongate, rigid (horizontal) third cross-link members—in the illustrated embodiment, cross-link members 130A, 130B, 130C, 130D (collectively, cross-link members 130). As explained below, cross-link members 130 are coupled to opposed second frame members 112, 122 of frame sections 110, 120, such that the quadrilaterals formed by joined cross-link members 130 and second frame members 112, 122 exhibit collapsible/expandable parallelogram geometry (in corresponding horizontal planes)—i.e. the quadrilaterals formed by joined cross-link members 130 and second frame members 112, 122 are parallelogram-collapsible.

In the illustrated embodiment, cross-link members 130 are pivotally coupled to second frame members 112, 122 so as to extend between corresponding corners of frame sections 110, 120. Each coupling between one of cross-link members 130 and one of second frame members 112, 122 provides relative pivotal motion about a single pivot axis. In particular:

cross-link member 130A is coupled at opposite ends to the first ends of second frame members 112A, 122A for pivotal movement confined about vertical axes 130A-I, 130A-II. As shown in FIG. 5A, cross-link member 130A may be coupled to the undersides of second frame members 112A, 122A. In embodiments, where second frame members 112A, 122A have L-shaped cross-sections, cross-link member 130A may be pivotally coupled to the undersides of the horizontal legs of second frame members 112A, 122A;

cross-link member 130B is coupled at opposite ends to the first ends of second frame members 112B, 122B for pivotal movement confined about vertical axes 130B-I, 130B-II. As shown in FIG. 5A, cross-link member 130B may be coupled to the undersides of second frame members 112B, 122B. In embodiments, where second frame members 112B, 122B have L-shaped cross-sections, cross-link member 130B may be pivotally coupled to the undersides of the horizontal legs of second frame members 112B, 122B;

cross-link member 130C is coupled at opposite ends to the second ends of second frame members 112A, 122A for pivotal movement confined about vertical axes 130C-I (not shown), 130C-II. As shown in FIG. 5A, cross-link member 130C may be coupled to the undersides of second frame members 112A, 122A. In embodiments, where second frame members 112A, 122A have L-shaped cross-sections, cross-link member 130C may be pivotally coupled to the undersides of the horizontal legs of second frame members 112A, 122A; and cross-link member 130D is coupled at opposite ends to the second ends of second frame members 112B, 122B for pivotal movement confined about vertical axes 130D-I (not shown), 130D-II. As shown in FIG. 5A, cross-link member 130D may be coupled to the undersides of second frame members 112B, 122B. In embodiments, where second frame members 112B, 122B have L-shaped cross-sections, cross-link member 130D may be pivotally coupled to the undersides of the horizontal legs of second frame members 112B, 122B.

The inter-frame-section spacing between each pair of (horizontally) adjacent (vertical) axes linked by a cross-link member is the same as the inter-frame-section spacing between each corresponding pair of axes linked by the other cross-link members (e.g., the spacing between (vertical) axes 130A-I and 130A-II, which are linked by cross-link member 130A, is the same as the spacing between (vertical) axes 130B-I and 130B-II, which are linked by cross-link member 130B; and also the same as the spacing between (vertical) axes 130C-I and 130C-II, which are linked by cross-link member 130C; and also the same as the spacing between (vertical) axes 130D-I and 130D-II, which are linked by cross-link member 130D). As a result, frame sections 110, 120 (and second frame members 112, 122) are parallel to one another regardless of the angular orientation between coupled second frame members 112, 122 and cross-link members 130.

Further, the intra-frame-section spacing between each pair of (horizontally) adjacent (vertical) axes linked by a second frame member is the same as the intra-frame-section spacing between each corresponding pair of axes linked by the other second frame members (e.g., the spacing between (vertical) axes 130A-I and 130C-I, which are linked by second frame member 112A, is the same as the spacing between (vertical) axes 130A-II and 130C-II, which are linked by second frame member 122A; and also the same as the spacing between (vertical) axes 130B-I and 130D-I, which are linked by second frame member 112B; and also the same as the spacing between (vertical) axes 130B-II and 130D-II, which are linked by second frame member 122B). As a result, cross-link members 130 are parallel to one another regardless of the angular orientation between coupled second frame members 112, 122 and cross-link members 130.

The net result of this axial spacing is that the quadrilaterals formed by joined second and cross-link members ([112A, 130A, 122A and 130C] and [112B, 130B, 122B and 130D]) exhibit pivotally collapsible/expandable parallelogram geometry in parallel (horizontal) planes. This pivotally collapsible/expandable parallelogram geometry is best exhibited by comparing FIGS. 1A, 2A and 3A, where frame module 100 shown in horizontally collapsed (FIG. 1A), partially-horizontally-expanded (FIG. 2A) and fully-horizontally-expanded (FIG. 3A) configurations. Because of the above-described axial spacing, the shapes of the quadrilaterals formed by coupled second frame members 112, 122 and cross-link members 130 retain their parallelogram shape exhibited in FIGS. 1A, 2A and 3A regardless of their states of horizontal expansion. It will be appreciated that the same conditions on axial spacing will result in pivotally collapsible/expandable parallelogram geometry in embodiments having different numbers of second frame members 112, 122 and/or cross-link members 130.

In view of the foregoing, it may be appreciated that building frame module 100 of the illustrated embodiment comprises a plurality (e.g. a pair) of parallelogram frame sections 110, 120 pivotally parallelogram-collapsible in parallel first planes, each frame section 110, 120 having a plurality (e.g. a pair) of spaced-apart parallel members (e.g. second frame members 112, 122), each parallel member linked to a corresponding parallel member of the other frame section(s) by a plurality (e.g. a pair) of spaced-apart cross-link members 130 such that linked parallel members and cross-link members form parallelograms collapsible in planes perpendicular to the first planes. Frame module 100 may be described as a parallelepiped pivotally collapsible in perpendicular planes.

Figure 1B:
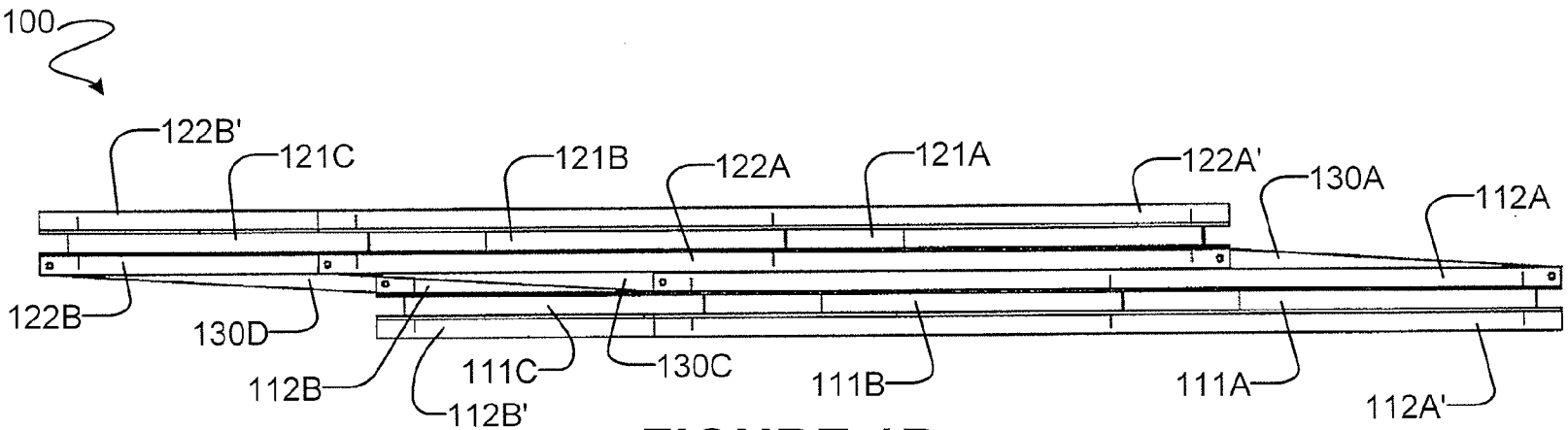
FIG. 1B is a bottom plan view of the frame module depicted in FIG. 1A.
Figure 1C:
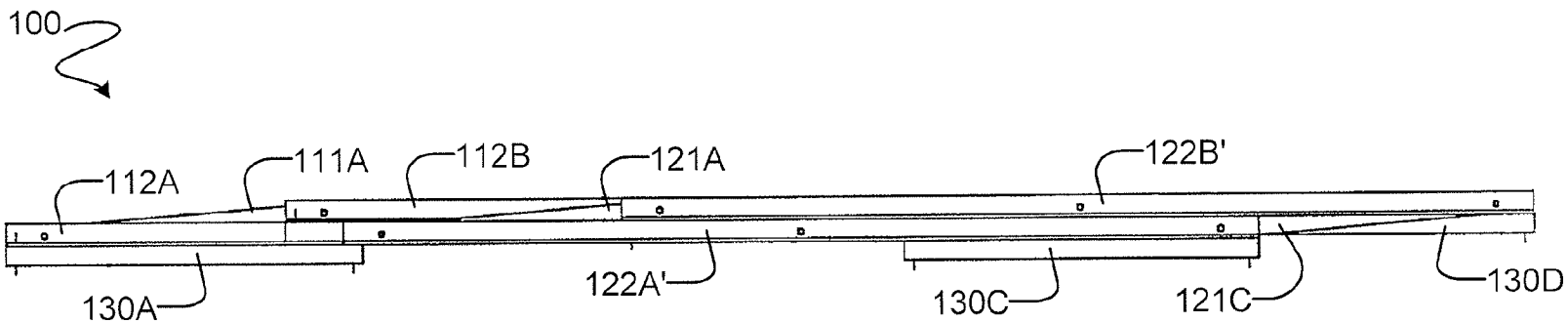
FIG. 1C is a side elevation view of the FIG. 1A frame module.

The erection of building frame module 100 to provide a structural frame will now be described. FIGS. 1A-C show frame module 100 in a fully-collapsed configuration. From FIGS. 1A-C, it can be seen that in the fully-collapsed configuration, frame module 100 is relatively compact. In some embodiments, the size of fully-collapsed frame module may be selected to meet particular transportation constraints—e.g. the dimensions of a shipping container on a marine vessel or train and/or the dimensions for transport by truck and trailer. In the fully-collapsed configuration, frame sections 110, 120 are in vertically-collapsed configurations and the linking quadrilaterals formed by joined second frame members 112, 122 and cross-link members 130 are in horizontally-collapsed configurations.

In the vertically-collapsed configuration (FIGS. 1A-1C, 2A-2C and 3A-3C), the angular displacements between coupled ones of first frame members 111, 121 and second frame members 112, 122 are small (e.g., first frame members 111, 121 and second frame members 112, 122 are nearly parallel and have relative angular displacements less than 10°), such that second frame members 112, 122 coupled adjacent the same face of a frame section 110, 120 are closely spaced (e.g., by less than the cross-sectional width of first frame members 111, 121). In some embodiments, contact between second frame members 112, 122 coupled adjacent the same face of a frame section 110, 120 limits the minimum angular displacements between coupled ones of first frame members 111, 121 and second frame members 112, 122 (e.g., as shown in FIG. 1A, contact between second frame members 112A' and 112B' of frame section 110 prevents the angular displacements between the coupled ones of first frame members 111 and second frame members 112A' and 112B' from being any smaller). In some embodiments, contact between adjacent ones of first frame members 111, 121 limits the minimum angular displacements between coupled ones of first frame members 111, 121 and second frame members 112, 122.

In the horizontally collapsed configuration (FIGS. 1A-1C), the angular displacements between coupled ones of second frame members 112, 122 and cross-link members 130 are small (e.g., second frame members 112, 122 and cross-link members 130 are nearly parallel with relative angular displacements of less than 10°), such that frame sections 110, 120 are closely spaced (e.g., by less than the cross-sectional width of cross-link members 130). In some embodiments, contact between opposed second frame members 112, 122 of opposed frame sections 110, 120 limits the minimum angular displacements between coupled ones of second frame members 112, 122 and cross-link members 130 (e.g., as shown in FIG. 1A, contact between second frame members 112B and 122B prevents the angular displacements between the coupled ones of second frame members 112B and 122B and cross-link members 130B and 130D from being any smaller). In some embodiments, contact between adjacent cross-link members 130 of a linking quadrilateral limits the minimum angular displacements between coupled ones of second frame members 112, 122 and cross-link members 130 of the linking quadrilateral.

Figure 2A:
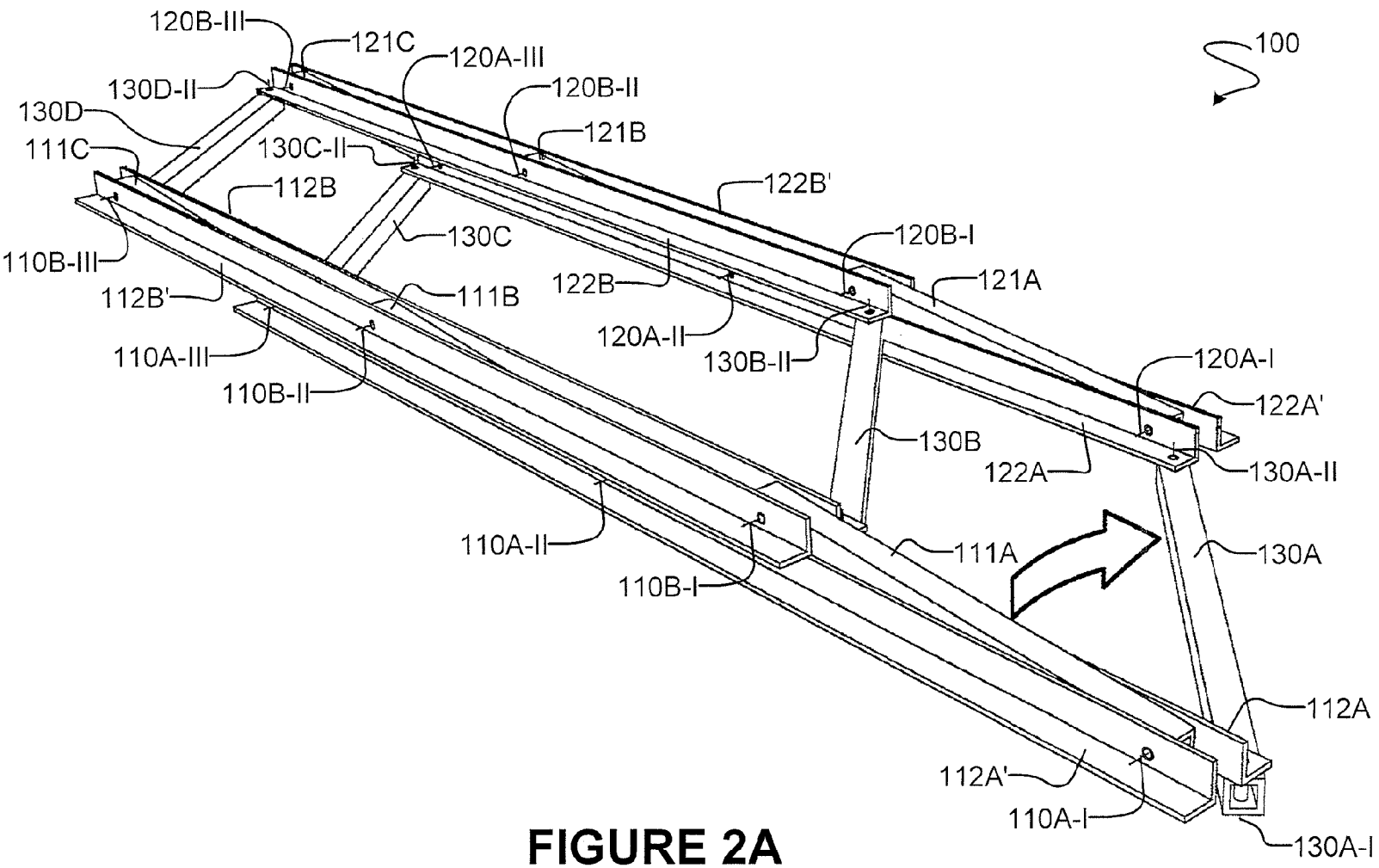
FIG. 2A is a perspective view of a frame module according to an example embodiment in a partially-horizontally-expanded and vertically-collapsed configuration.
Figure 2B:
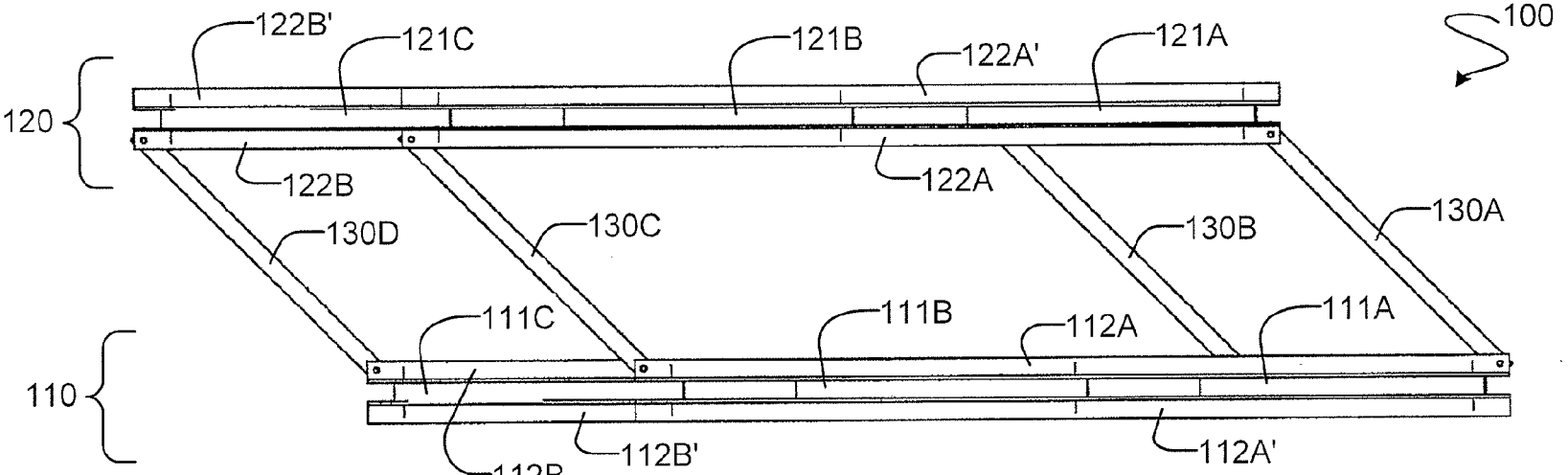
FIG. 2B is a bottom plan view of the frame module depicted in FIG. 2A.
Figure 2C:
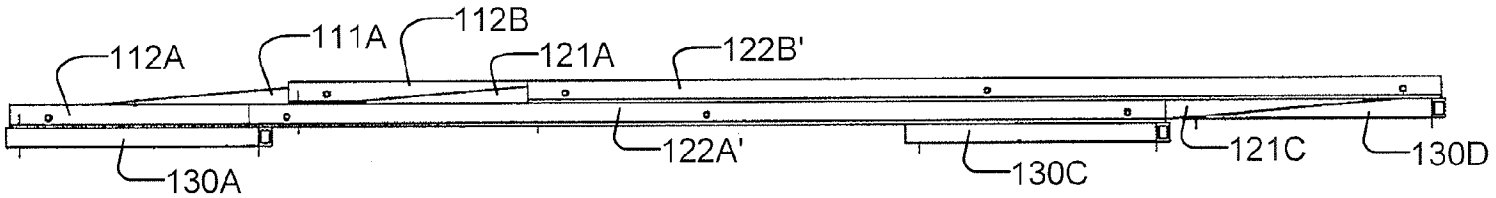
FIG. 2C is a side elevation view of the FIG. 2A frame module.

FIGS. 2A-C show frame module 100 in a partially-horizontally-expanded and vertically-collapsed configuration. The angular displacements between coupled second frame members 112, 122 and cross-link members 130 are larger in the partially-horizontally-expanded configuration than in the fully-collapsed configuration (FIG. 1A). As a result, frame sections 110, 120 are spaced apart. From FIGS. 2A-C, it can be seen that during horizontal expansion of frame module 100, cross-link members 130 pivot relative to second frame members 112, 122 in planes that are parallel to the planes containing second frame members 112, 122 (e.g. in horizontal planes), such that second frame members 112, 122 do not interfere with the pivotal motion of cross-link members 130 about axes 130A-I, 130A-II, 130B-I, 130B-II, 130C-I (not shown), 130C-II, 130D-I (not shown) and 130A-D-II.

Figure 3A:
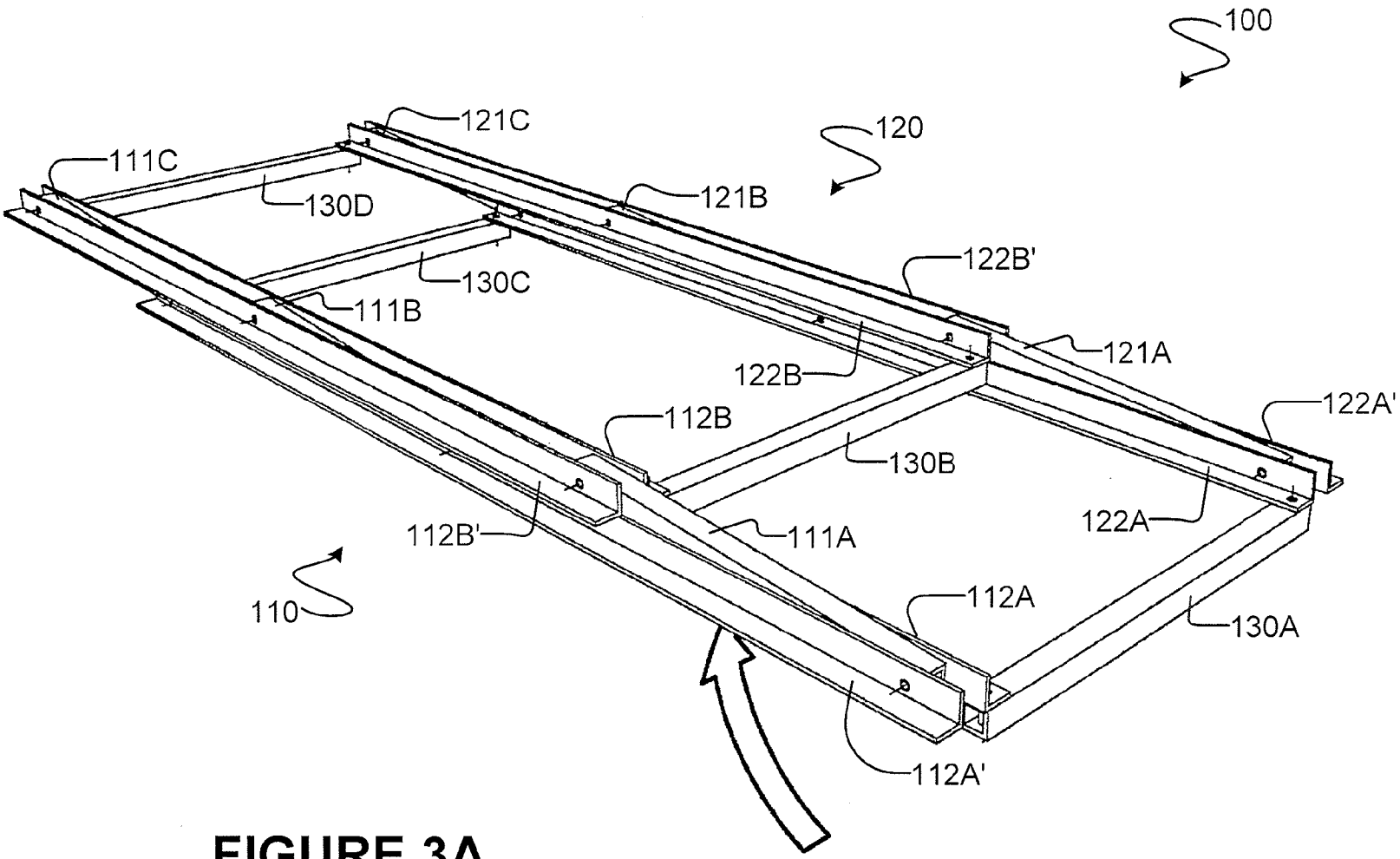
FIG. 3A is a perspective view of a frame module according to an example embodiment in a horizontally-expanded and vertically-collapsed configuration.
Figure 3B:
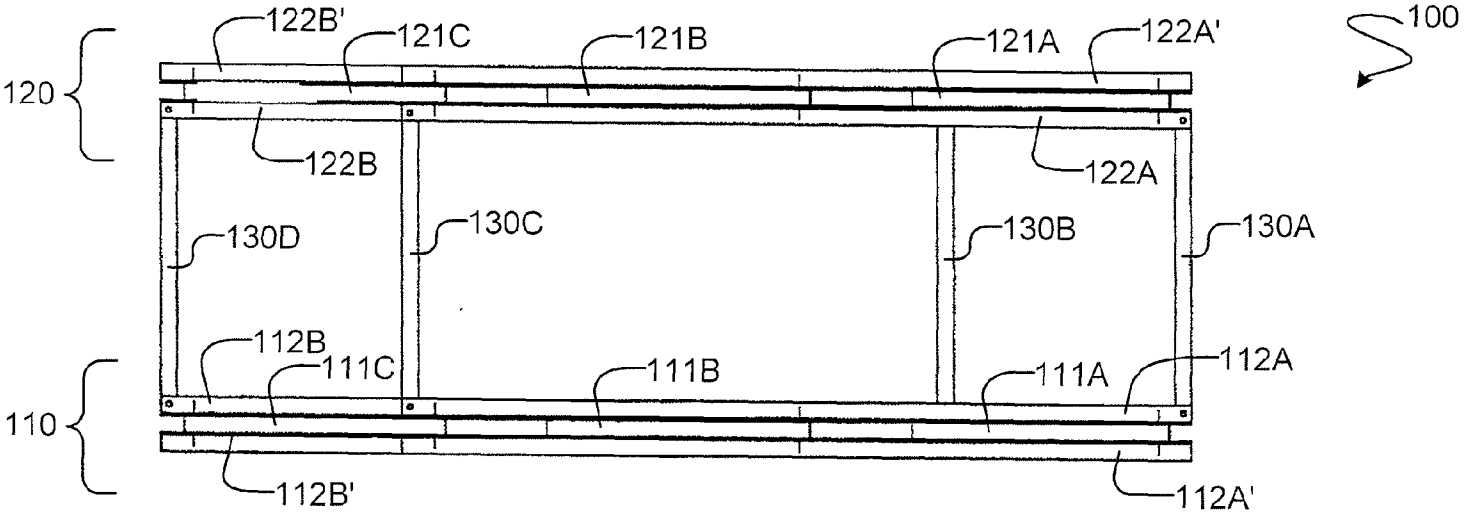
FIG. 3B is a bottom plan view of the frame module depicted in FIG. 3A.
Figure 3C:
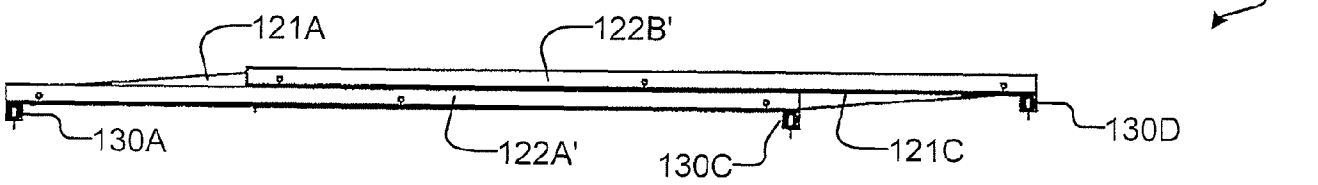
FIG. 3C is a side elevation view of the FIG. 3A frame module.

FIGS. 3A-C show frame module 100 a horizontally-expanded and vertically-collapsed configuration. In the horizontally-expanded configuration, the angular displacements between coupled second frame members 112, 122 and cross-link members 130 are approximately 90 degrees. In other words, cross-link members 130 are generally perpendicular to the planes of frame sections 110, 120.

In some embodiments, second frame members 112, 122 and/or cross-link members 130 comprise stops (not shown) configured to limit the maximum angular displacements between joined second frame members 112, 122 and cross-link members 130 at approximately 90 degrees. For example, a second frame member 112, 122 may comprise a stop configured to abut the leading face of a coupled cross-link member 130 when the angular displacement between the second frame member 112, 122 and the cross-link member 130 is approximately 90 degrees. For another example, the leading face of a cross-link member 130 may comprise a stop configured to abut the adjacent face of a coupled second frame member 112, 122 when the angular displacement between the second frame member 112, 122 and the cross-link member 130 is approximately 90 degrees. In some embodiments, adjacent faces of a coupled second frame member 112, 122 and cross-link member 130 each comprise a stop configured to abut the other stop when the angular displacement between the second frame member 112, 122 and the cross-link member 130 is approximately 90 degrees.

Figure 4A:
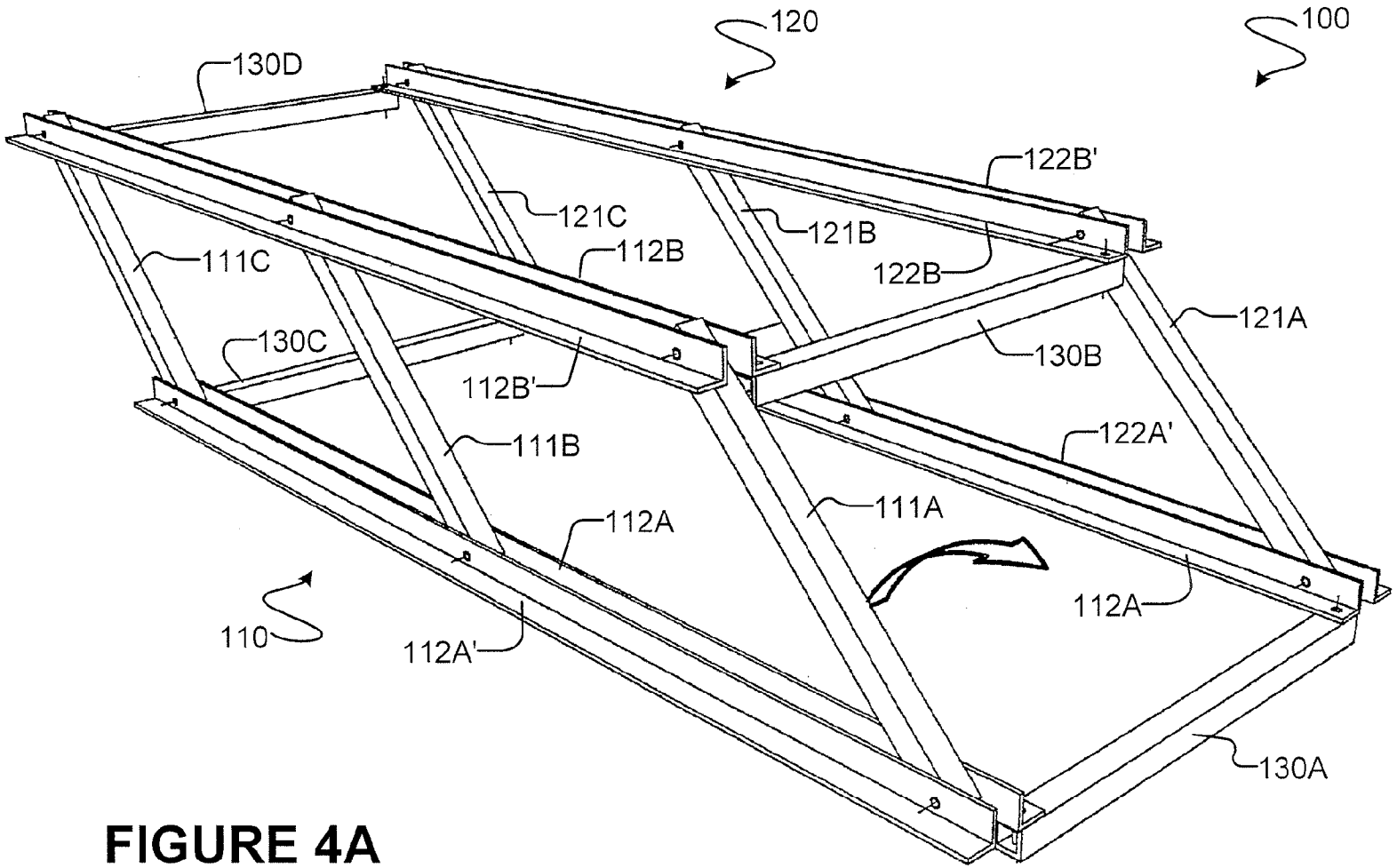
FIG. 4A is a perspective view of a frame module according to an example embodiment in a horizontally-expanded and partially-vertically-erected configuration.
Figure 4B:
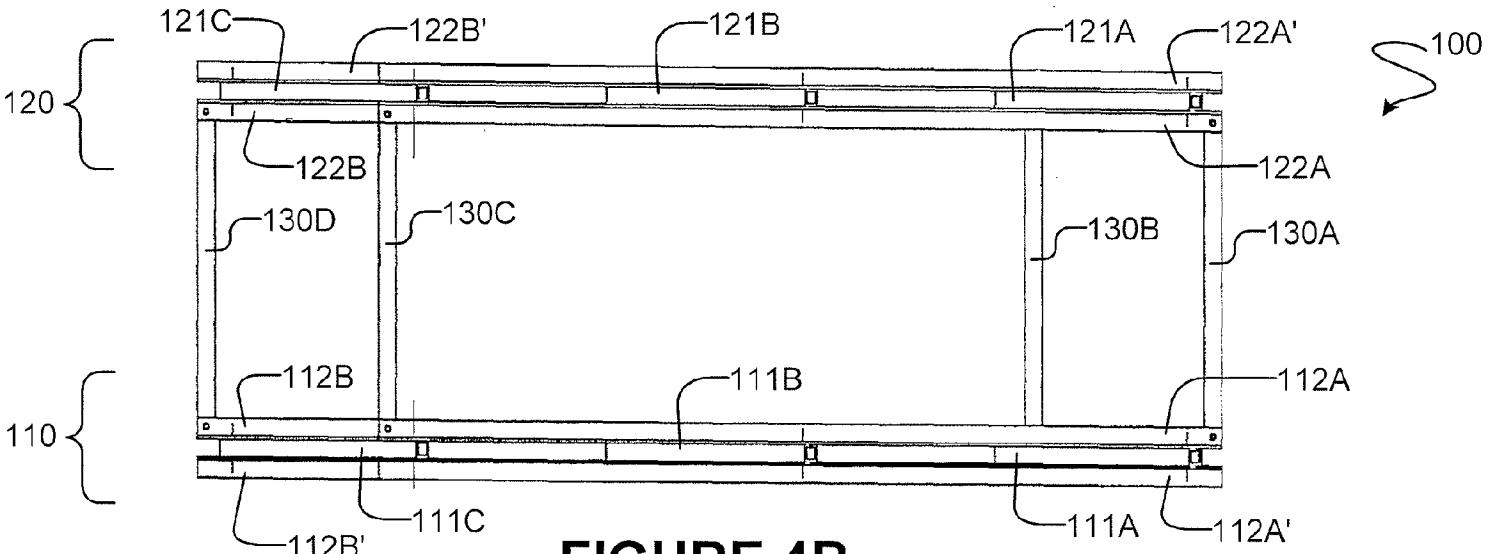
FIG. 4B is a bottom plan view of the frame module depicted in FIG. 4A.
Figure 4C:
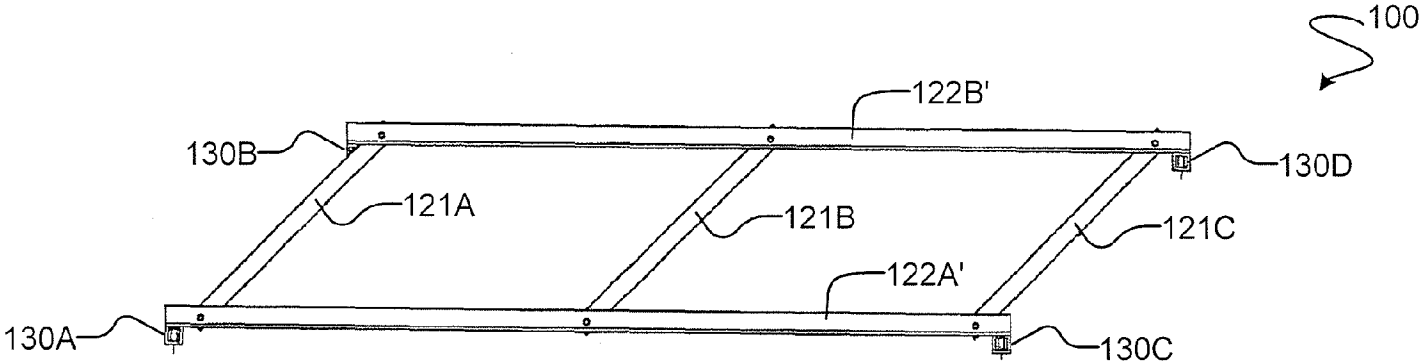
FIG. 4C is a side elevation view of the FIG. 4A frame module.

FIGS. 4A-C show frame module 100 in a horizontally-expanded and partially-vertically-erected configuration. The angular displacements between coupled ones of first frame members 111, 121 and second frame members 112, 122 are larger in the partially-vertically-expanded configuration than in the vertically-collapsed configuration. As a result, the second frame members 112, 122 coupled to the same faces of first frame members 111, 121 are spaced apart. From FIGS. 3A-3C and 4A-4C, it can be seen that during vertical erection of frame module 100, first frame members 111, 121 rotate relative to second frame members 112, 122 in planes that are parallel to the planes containing second frame members 112, 122 (e.g. in vertical planes).

Figure 5B:
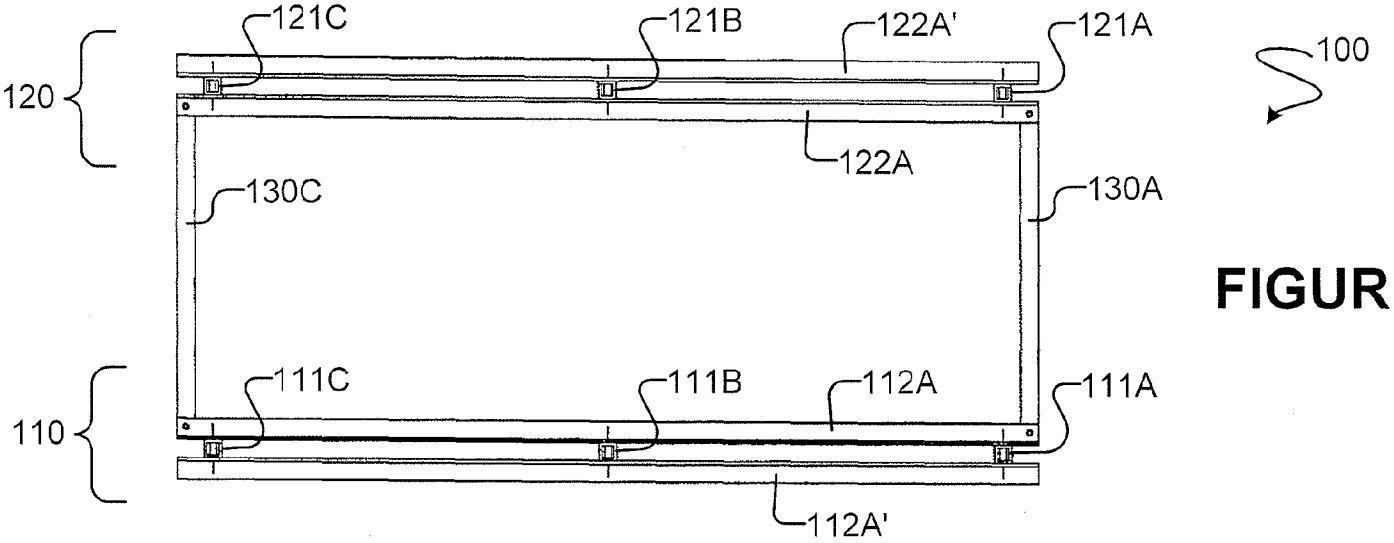
FIG. 5B is a bottom plan view of the frame module depicted in FIG. 5A.
Figure 5C:
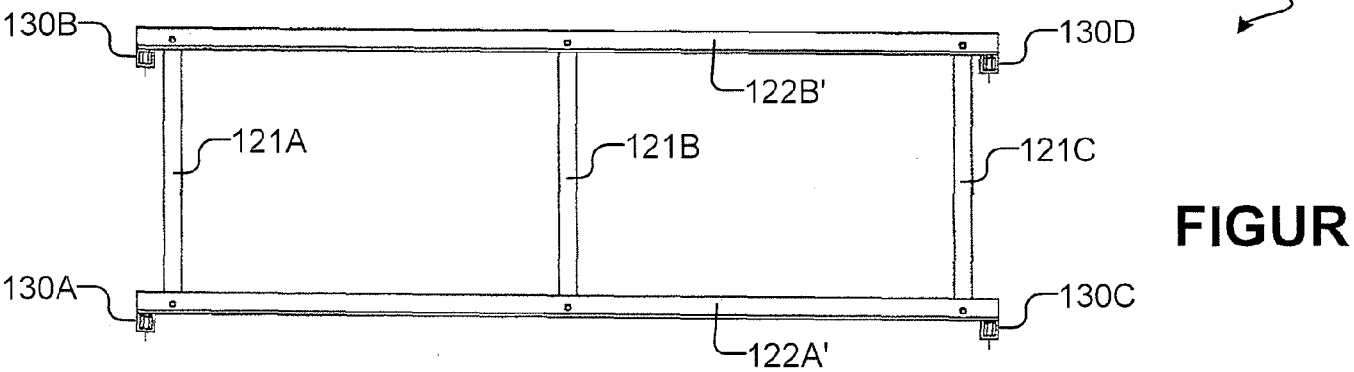
FIG. 5C is a side elevation view of the FIG. 5A frame module.

FIGS. 5A-C show frame module 100 in a fully-erect configuration. In the fully-erect configuration, the angular displacements between coupled first frame members 111, 121 and second frame members 112, 122 are approximately 90 degrees. In other words, first frame members 111, 121 are generally perpendicular to the second frame members 112, 122.

In some embodiments, first frame members 111, 121 and/or second frame members 112, 122 comprise stops configured to limit the maximum angular displacements between joined first and second frame members at approximately 90 degrees. For example, a second frame member 112, 122 may comprise a stop configured to abut the leading face of a coupled first frame member 111, 121 when the angular displacement between the second frame member 112, 122 and the first frame member 111, 121 is approximately 90 degrees. For another example, the leading face of a first frame member 111, 121 may comprise a stop configured to abut the adjacent face of a coupled second frame member 112, 122 when the angular displacement between the second frame member 112, 122 and the first frame member 111, 121 is approximately 90 degrees. In some embodiments, adjacent faces of a coupled second frame member 112, 122 and first frame member 111, 121 each comprise a stop configured to abut the other stop when the angular displacement between the second frame member 112, 122 and the first frame member 111, 121 is approximately 90 degrees.

The pivotal couplings of between frame and/or cross-link members may be implemented by any suitable mechanism. For example, pivotal couplings may be implemented by a suitable dowel (e.g. a bolt or the like) which extends through registered apertures in a pair of coupled frame and/or cross-link members. In some embodiments, couplings between frame and/or cross-link members include means for preventing unintended lock-up of the couplings (e.g., such as may occur due to corrosion or deformation due to loading during transportation). For example, dowels used to couple frame members and/or cross-link members may comprise bushings or other suitable bearings. For another example, couplings of face-wise adjacent coupled frame and/or cross-link members may comprise washers (e.g., comprising a non-corroding material) separating the facing surfaces of the coupled members.

In some embodiments, frame module 100 comprises means for fixing the angular displacements of coupled frame and/or cross-link members. For example, frame module 100 may comprise locking mechanisms, parts of locking mechanisms, and/or the like for fixing the angular displacements between one or more pairs of coupled second frame members 112, 122 and cross-link members 130 in one or both of the horizontally-collapsed and horizontally-expanded configurations. For another example, frame module 100 may comprise locking mechanisms, parts of locking mechanisms and/or the like, for fixing the angular displacements between one or more pairs of coupled first frame members 111, 121 and second frame members 112, 122 in one or both of the vertically-collapsed and vertically-erect configurations. In some embodiments, locking mechanisms comprise dowels (e.g. a bolt or the like) which extend through apertures in pairs of coupled frame and/or cross-link members at locations away from the pivot joints, which apertures are registered when the angular displacement between the frame and/or cross-link members corresponds to the configuration in which the members are to be fixed.

The method of erecting frame module 100 shown in FIGS. 1-5 may be performed at the location where a building (or a portion of a building) is to be constructed using common equipment. For instance, frame module 100 may be horizontally expanded by pulling frame section 110 away from section 120 by hand or with a suitable machine (e.g. a winch, tractor, piston, jack, or the like), and may be vertically expanded by lifting cross-link members 130B and 130D upward with a suitable machine (e.g. crane, piston, jack, or the like). In some embodiments, frame module 100 comprises anchors (e.g., apertures, rings, etc.) configured for attachment to equipment used to erect frame module 100 (e.g., hooks, etc.). In some embodiments, frame module 100 comprises markings to indicate where equipment (e.g., slings) should be attached to frame module 100 for erecting frame module 100).

Figure 6:
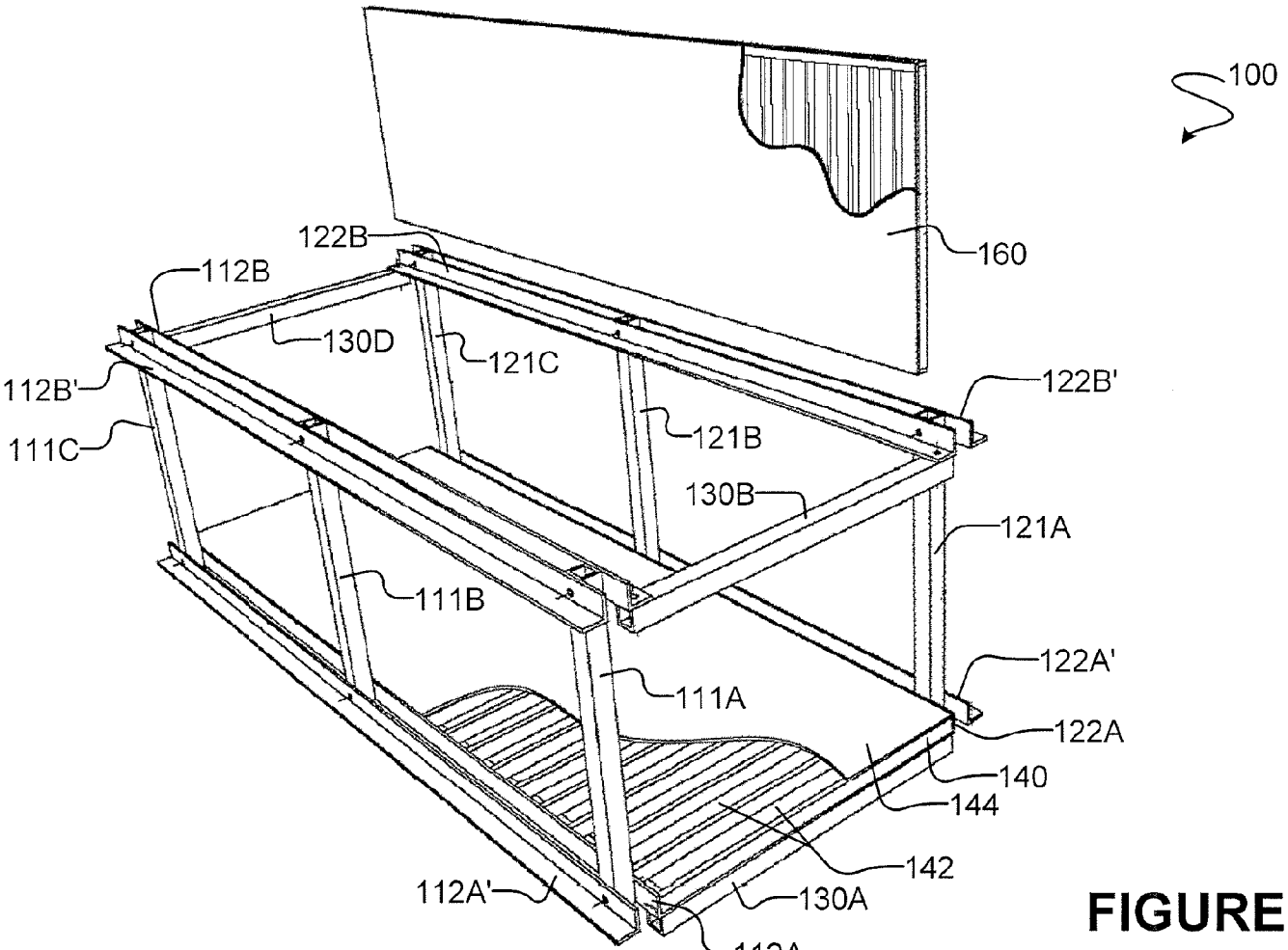
FIG. 6 is a partially cut-away perspective view of a frame module according to an example embodiment that has been partially configured to provide a room by adding interstitial steel stud framing to the vertical walls and floor/ceiling framing.

Frame module 100 of the illustrated embodiment includes a number of features which make it suitable for use in modular construction of buildings. FIG. 6 shows frame module 100 partially configured to provide a room. In FIG. 6, a platform section 140 is supported by the horizontal legs of the L-shaped cross-section of internal second frame members 112A, 122A, and confined by the vertical legs of the L-shaped cross-section of internal second frame members 112A, 122A, to provide a floor. Platform 140 may be installed onto internal second frame members 112A and 122A after frame module 100 has been fully erected—e.g. using a crane which may drop platform 140 into frame module 100 at a suitable angle. Platform 140 may be installed onto internal second frame members 112A and 122A when frame module 100 has been fully horizontally-expanded and partially vertically-erected—e.g., cross-linking members 130B and 130D may be raised apart from cross-linking members 130A and 130C by at least the height of platform 140 and platform 140 then slid into place. Those skilled in the art will appreciated the advantage of being able to install platforms while the second members and cross-linking members of a frame module are relatively close to the ground.

In the illustrated embodiment, platform 140 comprises steel joists 142 and flat steel decking 144. Platform 140 may be differently constructed and/or be made from different materials (e.g., carbon fiber composites, pre-cast steel reinforced concrete, aluminum, wood, wood laminates, plastic composites, engineered materials, etc.). For instance, decking 144 may be fabricated from corrugated steel or another suitable decking material (e.g., magnesium board, plywood, etc.). In some embodiments, the underside of platform 140 comprises hattrack or other furring channels.

Platform 140 may be pre-fabricated prior to installation in frame module 100 (e.g., in sizes convenient for transportation and handling). In some embodiments, platform 140 comprises a plurality of pre-fabricated platform sections which can be individually installed (e.g., horizontally adjacent to one another) in frame module 100. In some such embodiments, pre-fabricated platform sections may comprise means for fastening adjacent sections together (e.g., pre-drilled holes configured to register with corresponding pre-drilled holes on adjacent sections).

Platform 140 may be fastened to internal second frame members 112A, 122A, and/or to cross-link members 130A, 130C. In some embodiments, internal second frame members 112A, 122A, and/or cross-link members 130A, 130C comprise means for fastening platform 140 to frame module 100 (e.g., internal second frame members 112A, 122A may comprise pre-drilled holes configured to register with corresponding studs and/or with other pre-drilled fastener-receiving holes defined on pre-fabricated platform sections, or the like).

It will be appreciated that in other embodiments, second frame members 112, 122 may have different cross-sections and still be capable of supporting platform 140. For instance, a frame module 100 may have second frame members 112, 122 comprising angle beams with L-shaped cross-sections oriented so that their right angles open downwardly and toward the frame section opposite when the frame module 100 is in the erect configuration. In such a frame module 100, a platform 140 could be supported by the horizontal legs of the L-shaped cross-sections of second frame members 112, 122 and confined by the opposed faces of first frame members 111, 121 from opposite frame sections.

FIG. 6 also shows a wall panel 160. Wall panel 160 may be installed between platform 140 and the underside of one or both of internal second frame members 112B, 122B, between cross-link members 130B and 130D. Wall panel 160 may be installed in frame module 100 by being lowered diagonally through the linking quadrilateral formed by cross-link members 130B, 130D and internal second frame members 112B, 122B, and then being rotated to fit against either first members 111 or first members 121. Wall panel 160 may be fastened to one or more of first members 111, 121, internal second members 112B, 122B, cross-link members 130B, 130D, and platform 140.

As shown in the cut-away portion of the illustrated embodiment (FIG. 6), wall panel 160 may comprise conventional steel stud/channel construction and suitable facing (e.g., gyprock, magnesium board, wood or another suitable facing), although this is not necessary. In some embodiments, wall panel 160 is provided and installed without facing and facing may be added after installation of wall panel 160 in frame module 100. In some embodiments, one or both sides of wall panel 160 comprises hattrack or other furring channels. Wall panel 160 may comprise framed-in openings, for window frames, windows, doorways, doors, and/or the like.

Wall panel 160 may be pre-fabricated prior to installation in frame module 100 (e.g., in sizes convenient for transportation and handling). In some embodiments, wall panel 160 comprises a plurality of pre-fabricated wall sections which can be individually installed (e.g., horizontally adjacent to one another) in frame module 100. In some such embodiments, pre-fabricated wall sections may comprise means for fastening adjacent sections together (e.g., pre-drilled holes configured to register with corresponding studs and/or pre-drilled fastener-receiving holes on adjacent sections). In some embodiments, a wall may be constructed of steel studs individually fastened to first frame members 111, 121, second frame members 112, 122 and/or platform 140.

Wall panel 160 may be fastened to first frame members 111, 121, internal second frame members 112A, 122A, and/or to cross-link members 130A, 130C. In some embodiments, first frame members 111, 121, internal second frame members 112A, 122A, and/or cross-link members 130A, 130C (not visible in FIG. 6) comprise means for fastening wall panel 160 to frame module 100 (e.g., first frame members 111, 121, internal second frame members 112A, 122A, and/or cross-link members 130A-D may comprise pre-drilled holes configured to register with corresponding studs and/or pre-drilled fastener-receiving holes defined on pre-fabricated wall sections, or the like).

In some embodiments, components of frame module 100, platforms 140 and/or wall panels 160 may be configured to accommodate installation of building services. For instance, components of frame module 100, platforms 140 and/or wall panels 160 may comprise apertures, conduits, ducts, racks or the like for accommodating the installation of wiring, piping or the like for electrical, plumbing, HVAC, communications, and other building services. In some embodiments, frame module 100, platforms 140 and/or wall panels 160 comprise pre-installed building service components (e.g., pipes, ducts, wiring, sockets, light fixtures, jacks, etc.).

Frame modules 100 according to some embodiments may be combined to provide a structural frame for a building or a building portion. For instance, frame modules 100 according to some embodiments may be arrayed sideways horizontally, endwise horizontally and/or vertically. Adjacent frame modules 100 in arrays of frame modules 100 may be fastened together before or after being vertically erected. For example, an array of frame modules 100 (e.g., a plurality of frame modules 100 arrayed sideways horizontally and/or endwise horizontally) may be simultaneously vertically erected after adjacent frame modules 100 of the array are linked together.

In some embodiments, a structural frame is provided by directly coupling one frame module 100 to another. For example, frame modules 100 may be arrayed sideways horizontally by abutting and/or connecting opposed external second frame members 112A', 112B' and 122A', 122B' of adjacent frame modules 100. In some embodiments, the second frame members 112, 122 of frame modules 100 extend endwise beyond the end-most first frame members 111, 121, such that a corridor (e.g., a hallway) for accessing the interiors of frame modules 100 (e.g., such as when they are configured as habitable rooms) may be provided by arraying frame modules 100 endwise horizontally (e.g., by abutting and/or connecting the ends of corresponding second frame members 112, 122).

Figure 7:
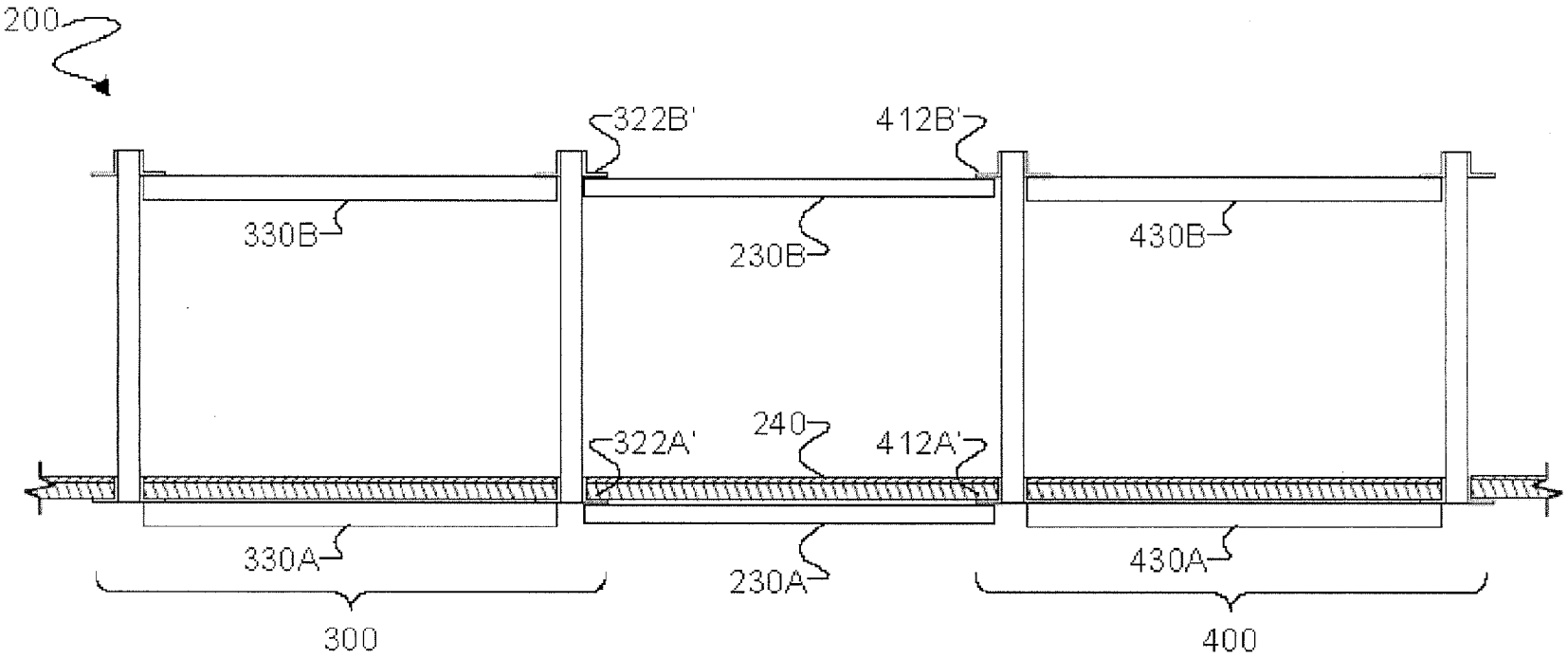
FIG. 7 is an end elevation view of a structural frame comprising two frame modules according to an example embodiment.

In some embodiments, a structural frame is provided by coupling one frame module 100 to another using linking members. FIG. 7 shows an end elevation view of a structural frame 200 comprising two, sideways horizontally arrayed frame modules 300, 400, each of which is similar to frame module 100. Frame modules 300, 400 are joined by a platform 240 that is fastened between external second frame member 322A' of frame module 300 and external second frame member 412A' of frame module 400. Platform 240 of the illustrated embodiment is supported by the horizontal legs of the L-shaped cross-sections of external second frame members 322A', 412A', and confined by the vertical legs of the L-shaped cross-sections of external second frame members 322A', 412A'. In some embodiments, external second frame members 322A', 412A' comprise means for facilitating the fastening platform 240 to frame modules 300, 400 (e.g., external second frame members 322A', 412A' may include apertures configured to register with corresponding studs and/or pre-drilled fastener-receiving apertures formed on platform 240).

Platform 240 may be fastened between external second frame members 322A', 412A' before or after frame modules 300, 400 have been vertically erected. For example, platform 240 may be fastened between external second frame members 322A', 412A' when frame modules 300, 400 have been fully horizontally-expanded and partially vertically-erected—e.g., cross-linking members 330B, 330D (not shown) and 430B, 430D (not shown) may be raised apart from cross-linking members 330A and 330C (not shown) and 430A and 430C (not shown) by at least the height of platform 240 and platform 240 then fastened between external second frame members 322A', 412A'.

In some embodiments, frame sections 300, 400 are joined together by means other than (i.e., in place of or in addition to) platform 240. For example, frame sections 300, 400 may be joined by external linking members 230A and/or 230B fastened to the undersides of the horizontal legs of the L-shaped cross-sections of external second frame members 322A', 412A' and 322B', 412B', respectively, and/or external linking members 230C (not shown) and/or 230D (not shown) fastened to the undersides of the horizontal legs of the L-shaped cross-sections of external second frame members 322A', 412A' and 322B', 412B', respectively. External linking members 230A-D may comprise members having I-shaped, C-shaped, L-shaped, H-shaped and/or T-shaped cross-sections, tubing having other cross-sectional shapes (e.g. circular cross-section), or the like. In some embodiments, external second frame members 322A', 412A', 322B', 412B' comprise means for facilitating the fastening platform of external linking members 230A-D to frame modules 300, 400 (e.g., external second frame members 322A', 412A', 322B', 412B' may include apertures configured to register with corresponding apertures formed on external linking members 230A-D).

External linking members may be fastened to frame modules 300, 400 before or after frame modules 300, 400 have been erected. For example, frame modules 300, 400 may be simultaneously vertically erected after being linked together by external linking members 322A', 412A', 322B', 412B'.

In some embodiments, frame modules 300, 400 comprise one or more external linking members each pivotally coupled to one of second frame members 322A', 412A', 322B' and 412B' at pivot joints that permit relative pivotal motion about a corresponding single axis. Such external linking members may be pivotable from a retracted configuration, in which they are substantially parallel to the second frame member to which they are attached, to an extended configuration, in which they extend substantially perpendicular to the second frame member to which they are attached. A structural frame may be provided by pivoting such external linking members from their retracted configuration to their extended configuration, and fastening the free ends of the external linking member to the corresponding second frame members of an adjacent frame module.

Figure 8A:
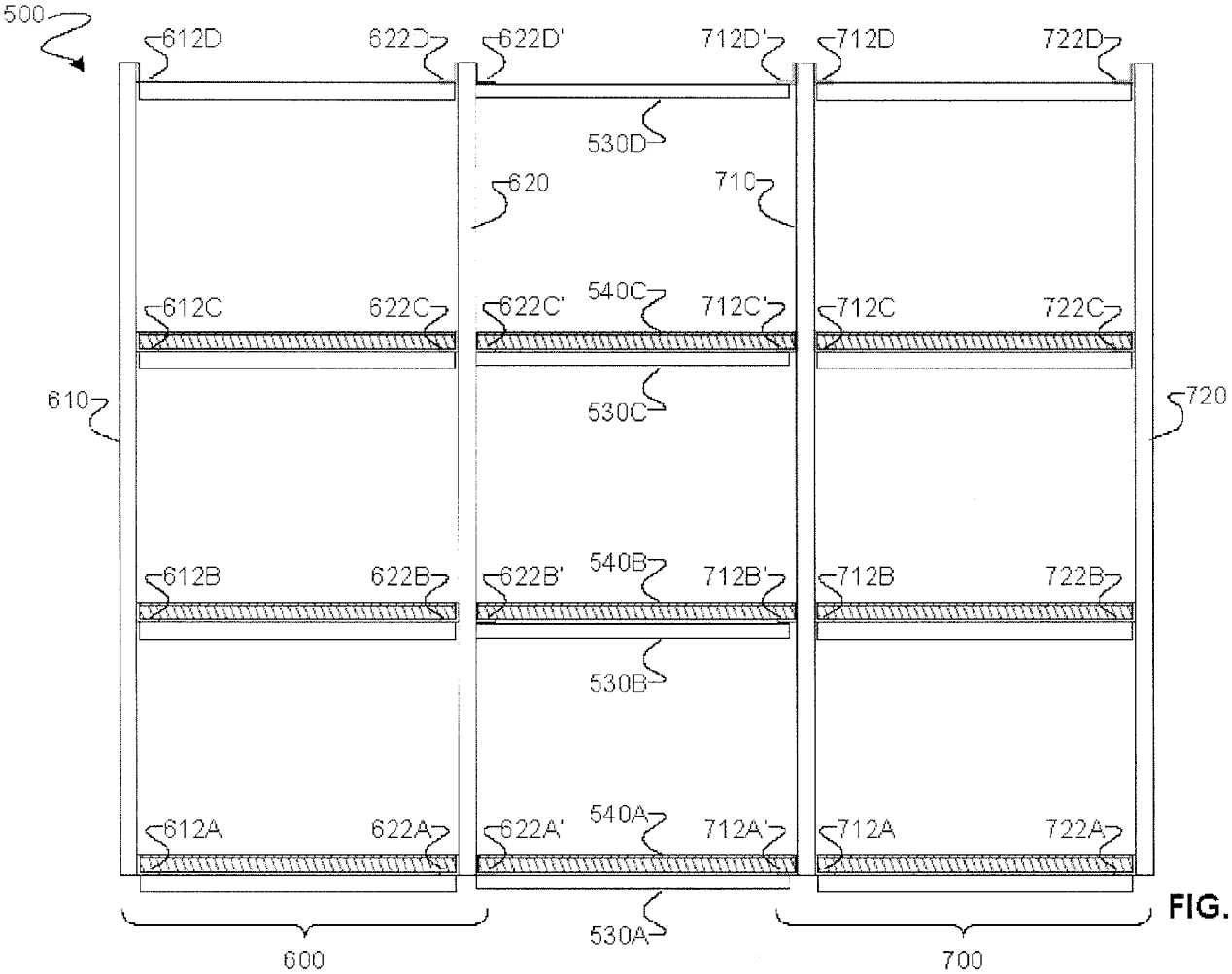
FIGS. 8A, 8B and 8C are end elevation, top plan and side elevation views of a structural frame comprising four frame modules according to an example embodiment.
Figure 8B:
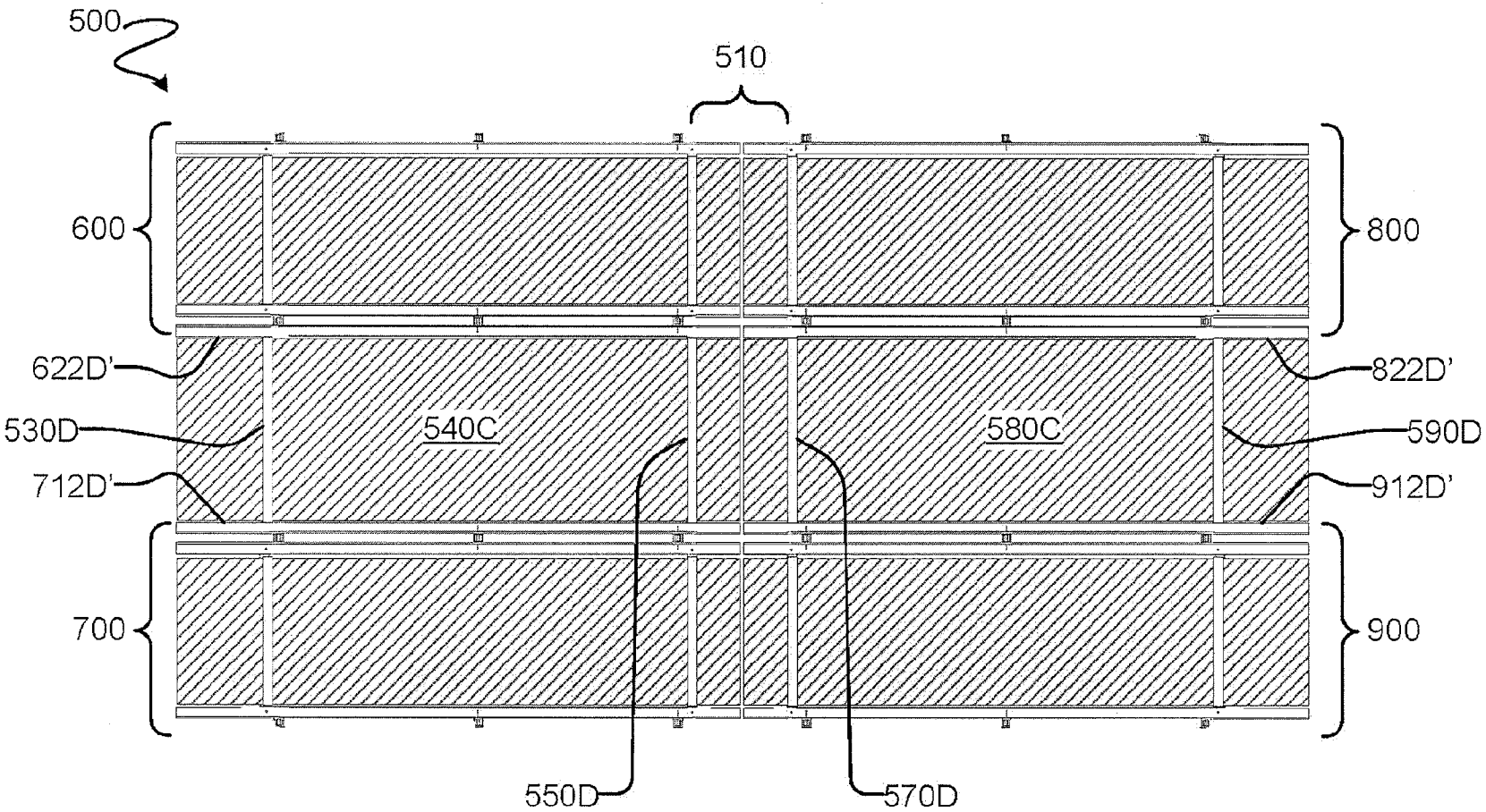

FIGS. 8A and 8B show end elevation and top plan views of a structural frame 500 comprising four frame modules 600, 700, 800 and 900. Frame modules 600 and 700 are sideways horizontally adjacent. Frame modules 800 and 900 are sideways horizontally adjacent. Frame modules 600 and 800 are end-ways horizontally adjacent. Frame modules 700 and 900 are end-ways horizontally adjacent. It will be appreciated that structural frame 500 may be made larger by the addition of more frame modules.

In structural frame 500, frame modules 600, 700 are joined by platforms 540A, 540B and 540C (collectively, platforms 540), which are fastened between pairs of opposed external second frame members, respectively, 622A' and 712A', 622B' and 712B', and 622C' and 712C'. Similarly, frame modules 800, 900 are joined by platforms 580A (not shown), 580B (not shown) and 580C (collectively, platforms 580), which are fastened between pairs of opposed external second frame members, respectively, 822A' (not shown) and 912A' (not shown), 822B' (not shown) and 912B' (not shown), and 822C' (not shown) and 912C' (not shown). It will be appreciated that platforms 540 and 580 provide a vertical array of floors without doubling up of platform sections between vertically adjacent rooms.

Figure 8C:
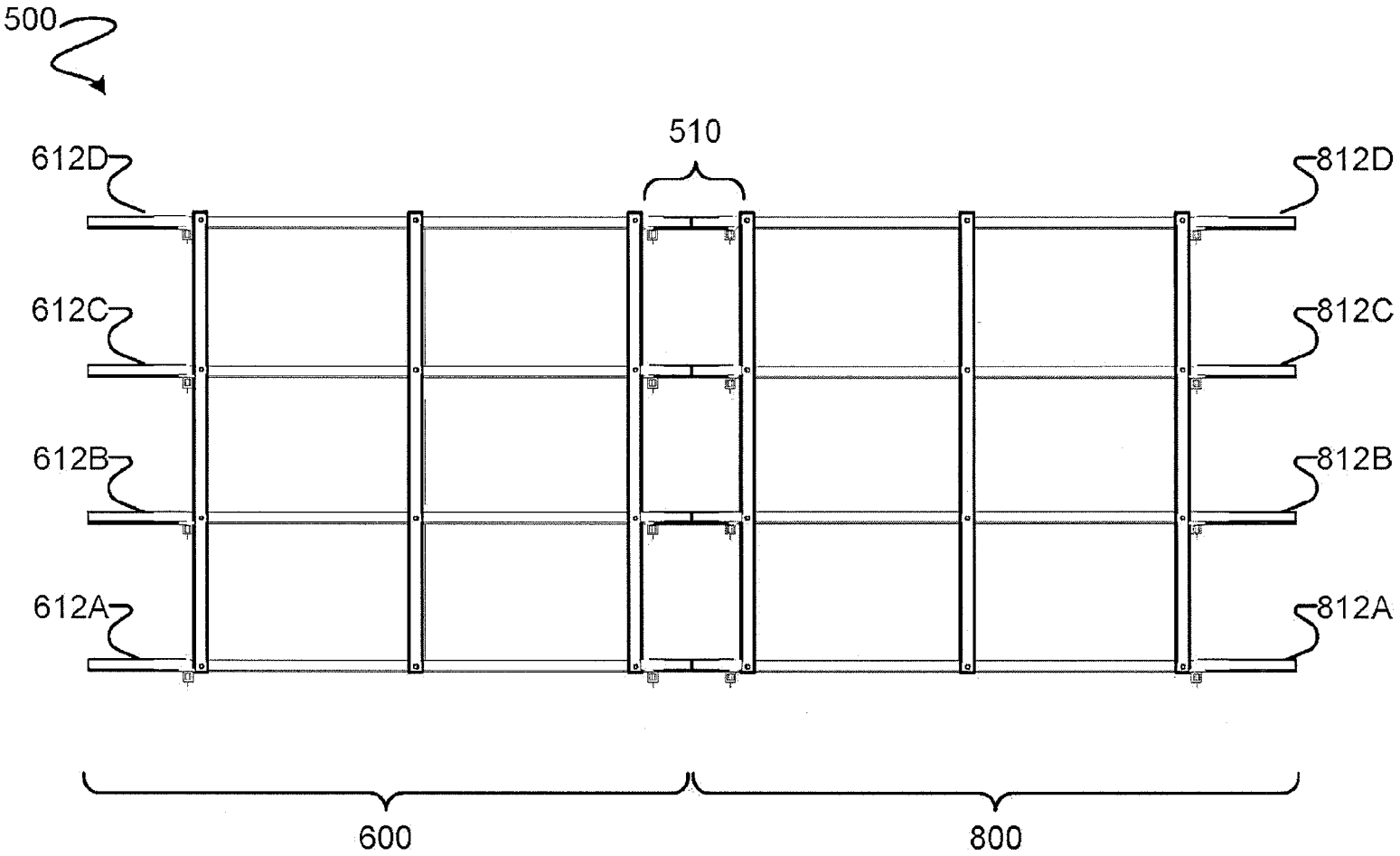

As can be seen in FIGS. 8B and 8C, second frame members (e.g., 612A-D, 622D, 622D', 712D, 712D', 722D and 812A-D) extend past the first frame members to which they are coupled. In frame 500, the second frame members extend further past the first frame member at one end of their respective frame modules than the first frame member at the other end of their respective frame modules (e.g., second frame members 612A extend further past first frame member 611A than first frame member 611C). The relatively shorter extensions of the second frame members past the first frame members are coupled at their ends to corresponding ends of the second frame members of endwise adjacent frame modules (e.g., second frame members 612A-D of frame module 600 are coupled, respectively, to second frame members 812A-D of frame module 800) to provide a corridor 510 through the structural frame 500. The relatively longer extensions of the second frame members past the first frame members extend endwise outwardly from structural frame 500. These portions of the platforms between these endwise outward extension may be used as balconies, for example.

As with structural frame 200, frame sections 600, 700 may be joined together by means other than (i.e., in place of or in addition to) platforms 540, such as by external linking members 530A-D, 550A-D (550A-C not shown), 570A-D (570A-C not shown) and 590A-D (590A-C not shown).

In some embodiments, frame modules 100 are adapted to be arrayed vertically. For example, the top ends of first frame members 111, 121 of a first frame module 100 may comprise or be provided with an external (or internal) sleeve configured to accept (or be accepted in) the bottom ends of first frame members 111, 121 of a second frame module 100. It will be appreciated that the ends of first frame members 111, 121 may comprise or be provided with other types of cooperating connection elements configured to facilitate vertical stacking of frame modules 100, such as interlocking tabs and slots, for example.

In some embodiments, first frame members of a frame module may extend below the lowest second frame members of the frame module when the frame module is in its vertically erect configuration. The downwardly extending portions of the first frame members may be secured to the ground. For example, the downwardly extending portions of the first frame members may be received in sleeves, received over posts, cast in concrete, and/or the like. Downwardly extending portions of the first frame members may comprise projections, apertures or other features for anchoring to the ground (e.g., such as by bolting, welding, casting in concrete, or the like).

After frame module 100 (or a structural frame comprising a plurality of frame modules) has been erected, the frame may be stiffened to provide additional structural rigidity and stability. Some examples of how a frame module or structural frame may be stiffened after being erected include the following:

- Frame and/or cross-link members may be locked in their expanded/erected configurations by bracing-based locking mechanisms (e.g. angular bracing). In non-limiting example applications, such bracing-based locking mechanisms may be installed to extend between first frame members 111, 121 and second frame members 112, 122 and/or between second frame members 112, 122 and cross-link members 130. For another example, steel straps may be fastened to diagonally span frame sections 110, 120. Frame module 100 may comprise means for fastening strapping or bracing.
- Concrete or the like may be poured into the hollow elements of frame module 100 (e.g., hollow steel tubing of first frame elements 111, 121, voids in platforms 140, voids in wall panels 160, etc.) after frame module 100 is erected.
- Concrete or the like may be poured between (and optionally above and/or below) horizontally adjacent frame members, cross-linking members and/or platforms to form concrete beams and/or a concrete diaphragm. Such beams and/or diaphragms may span a plurality of horizontally adjacent frame modules.
- Reinforced cores (e.g., cores suitable for elevator shafts or stairwells) may be formed in a column of vertically adjacent rooms and/or frame modules. For example, a steel mesh may be fastened to the inward facing first and second frame members of a column vertically adjacent rooms and/or frame modules and the mesh then sprayed with concrete (e.g., shot-crete).
- The external faces of a structural frame may be encased in concrete or the like. For example, a steel mesh may be fastened to the outward facing first and second frame members of a structural frame and the mesh then sprayed with concrete (e.g., shot-crete).

Where a component (e.g. a frame member, cross-link member, coupling, brace, strap, locking mechanism, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention. Unless otherwise qualified, references to end(s) and/or corner(s) of a component or components should be understood in a general sense. In some embodiments, a reference to an end or a corner of a component should be understood to mean within a distance less than 25% of the length of the component from the actual edge or corner of the component. In some embodiments, a reference to an end or corner of a component should be understood to mean within a distance less than 15% of the length of the component from the actual edge or corner of the component.

Unless the context clearly requires otherwise, throughout this description, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above detailed description of examples of the technology is not intended to be exhaustive or to limit the system to the precise form disclosed above. While specific examples of, and examples for, the system are described above for illustrative purposes, various equivalent modifications are possible within the scope of the system, as those skilled in the relevant art will recognize. The teachings of the technology provided herein can be applied to other systems, not necessarily the system described above. The elements and acts of the various examples described above can be combined to provide further examples. Aspects of the system can be modified, if necessary, to employ the systems, functions, and concepts of the various references described above to provide yet further examples of the technology.

These and other changes can be made to the system in light of the above Detailed Description. While the above description describes certain examples of the system, and describes the best mode contemplated, no matter how detailed the above appears in text, the system can be practiced in many ways. As noted above, particular terminology used when describing certain features or aspects of the system should not be taken to imply that the terminology is being redefined herein to be restricted to any specific characteristics, features, or aspects of the system with which that terminology is associated.

From the foregoing, it will be appreciated that specific examples of systems and methods have been described herein for purposes of illustration, but that various modifications may be made without deviating from the spirit and scope of the invention. Those skilled in the art will appreciate that certain features of embodiments described herein may be used in combination with features of other embodiments described herein, and that embodiments described herein may be practiced or implemented without all of the features ascribed to them herein. Such variations on described embodiments that would be apparent to the skilled addressee, including variations comprising mixing and matching of features from different embodiments, are within the scope of this invention.

As will be apparent to those skilled in the art in the light of the foregoing disclosure, many alterations, modifications, additions and permutations are possible in the practice of this invention without departing from the scope thereof. The embodiments described herein are only examples. Other example embodiments may be obtained, without limitation, by combining features of the disclosed embodiments.

What is claimed is:

1. A building frame module comprising:

first and second parallelogram-collapsible frame sections, each frame section comprising:

a plurality of elongate, rigid first frame members; and a plurality of elongate, rigid second frame members, each second frame member single-axis pivotally coupled at spaced apart locations to at least two of the plurality of first frame members and each first frame member correspondingly coupled to at least two second frame members; and a plurality of elongate, rigid cross-link members, each cross-link member linking a second frame member of the first frame section to a second frame member of the second frame section and single-axis pivotally coupled to each second frame member that it links for relative pivotal movement between the cross-link member and each second frame member that it links, each single-axis pivotal coupling between a cross-link member and a second frame member pivotal about an axis parallel to a plane in which the corresponding frame section is parallelogram-collapsible;

wherein the first and second parallelogram-collapsible frame sections and the plurality of cross-link members are configurable, by manipulation of a plurality of single-axis pivotal couplings between each plurality of second frame members and each plurality of first frame members and by manipulation of a plurality of single-axis pivotal couplings between the plurality of cross-link members and the first and second parallelogram-collapsible frame sections to define a parallelepiped-shaped building frame module whose interior is substantially free of frame components;

each second frame member of the first frame section comprising: a first internal second frame component located on a side of the first frame members of the first frame section that is proximate to the second frame section and a first external second frame component located on a side of the first frame members of the first frame section that is distal from the second frame section;

each second frame member of the second frame section comprising: a second internal second frame component located on a side of the first frame members of the second frame section that is proximate to the first frame section and a second external second frame component located on a side of the first frame members of the second frame section that is distal from the first frame section;

wherein the single-axis pivotal couplings between the first frame members and the second frame members of the first frame section each comprise a first pivotal coupling between a corresponding first frame member of the first frame section, a corresponding first internal second frame component and a corresponding first external second frame component for pivotal movement of the corresponding first internal second frame component and the corresponding first external second frame component together relative to the corresponding first frame member of the first frame section; and wherein the single-axis pivotal couplings between the first frame members and the second frame members of the second frame section each comprise a second pivotal coupling between a corresponding first frame member of the second frame section, a corresponding second internal second frame component and a corresponding second external second frame component for pivotal movement of the corresponding second internal second frame component and the corresponding second external second frame component together relative to the corresponding first frame member of the second frame section.

2. The building frame module of claim 1 wherein the cross-link members are coupled for pivotal movement about axes perpendicular to elongate dimensions of the second frame members independent of orientation of the second frame members relative to the first frame members.

3. The building frame module of claim 1 wherein the cross-link members are coupled for pivotal movement in a plane parallel to a plane that includes the second frame members it links independent of orientation of the second frame members relative to the first frame members.

4. The building frame module of claim 1 wherein the single-axis pivotal couplings between cross-link members and the second frame members of the first frame section are made between the cross-link members and the first internal second frame components and wherein the single-axis pivotal couplings between the cross-link members and the second frame members of the second frame section are made between the cross-link members and the second internal second frame components.

5. The building frame of claim 1 wherein for each frame section, at least one first frame member comprises a steel tube, a bore of the steel tube fillable with concrete.

6. The building frame of claim 1 wherein at least one cross-link member comprises a steel tube, a bore of the steel tube fillable with concrete.

7. A building frame module comprising:

first and second frame sections, each frame section comprising:

a plurality of elongate, rigid first frame members; and a plurality of elongate, rigid second frame members, each second frame member single-axis pivotally coupled at spaced apart locations to at least two of the plurality of first frame members and each first frame member correspondingly coupled to at least two second frame members;

wherein for a pair of first frame members linking two second frame members, a separation between the pivotal couplings on each second frame member of the two second frame members is the same as a separation between the pivotal couplings on the other second frame member of the two second frame members and a separation between pivotal couplings on each first frame member of the pair of first frame members is the same as a separation between the pivotal couplings on the other first frame member of the pair of first frame members; and a plurality of elongate, rigid cross-link members, each single-axis pivotally coupling a second frame member of the first frame section to a second frame member of the second frame section for relative pivotal movement between the cross-link member and each second frame member about an axis parallel to the first frame section;

wherein the first and second frame sections and the plurality of cross-link members are configurable, by manipulation of a plurality of single-axis pivotal couplings between each plurality of second frame members and each plurality of first frame members and by manipulation of a plurality of single-axis pivotal couplings between the plurality of cross-link members and the first and second frame sections to define a parallelepiped-shaped building frame module whose interior is substantially free of frame components;

each second frame member in the first frame section comprising: a first internal second frame component located on a side of the first frame members of the first frame section that is proximate to the second frame section and a first external second frame component located on a side of the first frame members of the first frame section that is distal from the second frame section;

each second frame member in the second frame section comprising: a second internal second frame component located on a side of the first frame members of the second frame section that is proximate to the first frame section and a second external second frame component located on a side of the first frame members of the second frame section that is distal from the first frame section;

wherein the single-axis pivotal couplings between the first frame members and the second frame members of the first frame section each comprise a first pivotal coupling between a corresponding first frame member of the first frame section, a corresponding first internal second frame component and a corresponding first external second frame component for pivotal movement of the corresponding first internal second frame component and the corresponding first external second frame component together relative to the corresponding first frame member of the first frame section; and wherein the single-axis pivotal couplings between the first frame members and the second frame members of the second frame section each comprise a second pivotal coupling between a corresponding first frame member of the second frame section, a corresponding second internal second frame component and a corresponding second external second frame component for pivotal movement of the corresponding second internal second frame component and the corresponding second external second frame component together relative to the corresponding first frame member of the second frame section.

8. A building frame module according to claim 7 wherein the first frame section is moveable in a first plane by relative movement about the pivotal couplings between the first frame members and the second frame members of the first frame section without pivotal movement of the pivotal couplings between the cross-link members and the second frame members of the first frame section and the second frame section is moveable in a second plane by relative movement about the pivotal couplings between the first frame members and the second frame members of second frame section without pivotal movement of the pivotal couplings between the cross-link members and the second frame members of the second frame section.

9. A building frame module according to claim 7 wherein the cross-link members are coupled for pivotal movement about axes perpendicular to elongate dimensions of the second frame members independent of orientation of the second frame members relative to the first frame members.

10. The building frame module of claim 7 wherein the cross-link members are coupled for pivotal movement in a plane parallel to a plane that includes the second frame members it links independent of orientation of the second frame members relative to the first frame members.

11. The building frame module of claim 7 wherein the plurality of cross-link members comprises four cross-link members, wherein two cross-link members are pivotally coupled to each second frame member of each of the first and second frame sections.

12. The building frame module of claim 7 comprising a third frame section and comprising a second plurality of elongate, rigid cross-link members each single-axis pivotally coupling a second frame member of the second frame section to a second frame member of the third frame section for relative pivotal movement between the cross-link member and each second frame member about an axis parallel to the second frame section.

13. A building frame module comprising:

first and second parallelogram-collapsible frame sections, each frame section comprising:

a plurality of at least three elongate, rigid first frame members; and a plurality of at least three elongate, rigid second frame members, each second frame member single-axis pivotally coupled at spaced apart locations to the plurality of first frame members and each first frame member correspondingly coupled to the second frame members;

wherein for each first frame member linking two second frame members, a separation between the pivotal couplings on the first frame member is the same as a separation between the pivotal couplings on the other first frame members and a separation between pivotal couplings on each of the two second frame members is the same as a separation between the pivotal couplings on the other second frame members; and a plurality of elongate, rigid cross-link members single-axis pivotally coupling each second frame member members of the first frame section to corresponding second frame members of the second frame section for relative pivotal movement between the each cross-link members member and each the second frame member members to which the cross-link member is coupled about axes parallel to the first frame section;

wherein the first and second frame sections and the plurality of cross-link members are configurable, by manipulation of a plurality of single-axis pivotal couplings between each plurality of second frame members and each plurality of first frame members and by manipulation of a plurality of single-axis pivotal couplings between the plurality of cross-link members and the first and second frame sections to define a parallelepiped-shaped building frame module whose interior is substantially free of frame components;

each second frame member in the first frame section comprising: a first internal second frame component located on a side of the first frame members of the first frame section that is proximate to the second frame section and a first external second frame component located on a side of the first frame members of the first frame section that is distal from the second frame section;

each second frame member in the second frame section comprising: a second internal second frame component located on a side of the first frame members of the second frame section that is proximate to the first frame section and a second external second frame component located on a side of the first frame members of the second frame section that is distal from the first frame section;

wherein the single-axis pivotal couplings between the first frame members and the second frame members of the first frame section each comprise a first pivotal coupling between a corresponding first frame member of the first frame section, a corresponding first internal second frame component and a corresponding first external second frame component for pivotal movement of the corresponding first internal second frame component and the corresponding first external second frame component together relative to the corresponding first frame member of the first frame section; and wherein the single-axis pivotal couplings between the first frame members and the second frame members of the second frame section each comprise a second pivotal coupling between a corresponding first frame member of the second frame section, a corresponding second internal second frame component and a corresponding second external second frame component for pivotal movement of the corresponding second internal second frame component and the corresponding second external second frame component together relative to the corresponding first frame member of the second frame section.

14. A building frame module according to claim 13 wherein the first frame section is moveable in a first plane by relative movement about the pivotal couplings between the first frame members and the second frame members of the first frame section without pivotal movement of the pivotal couplings between the cross-link members and the second frame members of the first frame section and the second frame section is moveable in a second plane by relative movement about the pivotal couplings between the first frame members and the second frame members of the second frame section without pivotal movement of the pivotal couplings between the cross-link members and the second frame members of the second frame section.

15. A building frame module according to claim 13 wherein the cross-link members are coupled for pivotal movement about axes perpendicular to elongate dimensions of the second frame members independent of orientation of the second frame members relative to the first frame members.

16. The building frame module of claim 13 wherein the cross-link members are coupled for pivotal movement in a plane parallel to a plane that includes the second frame members it links independent of orientation of the second frame members relative to the first frame members.

17. A building frame module according to claim 1 wherein the second frame members of the first and second frame sections are horizontally oriented independent of the a configuration of the plurality of single-axis pivot couplings and wherein each second frame member comprises an upwardly facing horizontal surface for supporting other building components.

18. A building frame module according to claim 17 wherein each cross-link member is single-axis pivotally coupled to each second frame member that it links at a location below each second frame member that it links to leave the upwardly facing horizontal surfaces of the second frame members free from obstruction for mounting other building components thereon.

19. A building frame module according to claim 1 wherein:

upon manipulation of the single-axis pivotal couplings to define the parallelepiped-shaped building frame module, the second frame members of the first and second frame sections are horizontally oriented and, for each second frame member of the first frame section, the first internal and external second frame components respectively comprise: a first internal upwardly facing horizontal surface on the side of the first frame members of the first frame section that is proximate to the second frame section for supporting other building components, and a first external upwardly facing horizontal surface on the side of the first frame members of the first frame section that is distal from the second frame section for supporting other building components, and, for each second frame member of the second frame section, the second internal and external second frame components respectively comprise: a second internal upwardly facing horizontal surface on the side of the first frame members of the second frame section that is proximate to the first frame section for supporting other building components, and a second external upwardly facing horizontal surface on the side of the first frame members of the second frame section that is distal from the first frame section for supporting other building components.

* * * * *